US009946180B2

(12) United States Patent
Kadonome et al.

(10) Patent No.: US 9,946,180 B2
(45) Date of Patent: Apr. 17, 2018

(54) TONER FOR DEVELOPING ELECTROSTATIC LATENT IMAGE

(71) Applicant: Konica Minolta, Inc., Tokyo (JP)

(72) Inventors: Futoshi Kadonome, Sagamihara (JP); Satoshi Uchino, Hino (JP); Kosuke Nakamura, Hachioji (JP); Koji Shibata, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/471,648

(22) Filed: Mar. 28, 2017

(65) Prior Publication Data

US 2017/0307991 A1 Oct. 26, 2017

(30) Foreign Application Priority Data

Apr. 21, 2016 (JP) ..... 2016-085557

(51) Int. Cl.

| | |
|---|---|
| ***G03G 9/08*** | (2006.01) |
| ***G03G 9/087*** | (2006.01) |
| ***G03G 9/113*** | (2006.01) |
| ***G03G 9/097*** | (2006.01) |

(52) U.S. Cl.

CPC ..... *G03G 9/08755* (2013.01); *G03G 9/0819* (2013.01); *G03G 9/08711* (2013.01); *G03G 9/09791* (2013.01); *G03G 9/113* (2013.01)

(58) Field of Classification Search

CPC ..... G03G 9/08755; G03G 9/08711; G03G 9/09791

USPC ..... 430/109.4

See application file for complete search history.

(56) References Cited

U.S. PATENT DOCUMENTS

| | | | | |
|---|---|---|---|---|
| 9,740,120 | B1 * | 8/2017 | Saito | G03G 9/09708 |
| 2010/0159381 | A1 * | 6/2010 | Takagi | G03G 9/0804 430/109.4 |
| 2017/0123334 | A1 * | 5/2017 | Kimpara | G03G 9/08788 |

FOREIGN PATENT DOCUMENTS

| | | | |
|---|---|---|---|
| JP | 2015007692 | A | 1/2015 |
| JP | 2015163950 | A | 9/2015 |

* cited by examiner

*Primary Examiner* — Mark A Chapman

(74) *Attorney, Agent, or Firm* — Lucas & Mercanti, LLP

(57) ABSTRACT

A toner for developing an electrostatic latent image includes: toner base particles containing a hybrid crystalline polyester resin having a crystalline polyester polymerized segment and an amorphous polymerized segment chemically bonded to each other and an amorphous resin; and an external additive including fatty acid metal salt particles, wherein a volume median diameter of the fatty acid metal salt particles is from 3.0 to 5.0 μm.

10 Claims, No Drawings

TONER FOR DEVELOPING ELECTROSTATIC LATENT IMAGE

The entire disclosure of Japanese Patent Application No. 2016-085557 filed on Apr. 21, 2016 including description, claims, drawings, and abstract are incorporated herein by reference in its entirety.

BACKGROUND OF THE INVENTION

Field of the Invention

The present invention relates to a toner for developing an electrostatic latent image (hereinafter, also simply referred to as toner).

Description of the Related Art

In recent years, needs for higher speed, higher image quality, and energy saving has increased in the image output using an electrophotographic process, and toners which can be fixed at a low temperature and exhibit stable cleaning property have been developed.

For the purpose of improving the cleaning property of toner, a technique to externally add a fatty acid metal salt (lubricant) as an external additive to toner base particles is known. The toner is uniformly coated onto the photoreceptor and uneven wear is suppressed, for example, in the case of a fatty acid metal salt which has a smaller particle diameter than the toner base particles as disclosed in JP 2015-163950 A, but the fatty acid metal salt particles move together with the toner base particles and reach the image portion on the paper. In addition, the supply of the fatty acid metal salt particles to the photoconductor is not necessarily sufficient and the external additive slips through to cause image defects in some cases.

Meanwhile, with regard to low temperature fixability, low temperature fixation of toner has been advanced for the purpose of coping with energy saving and high speed. In recent years, the low temperature fixability has been realized by a technique to impart sharp melt property to a binder resin by introducing a crystalline resin into a non-crystalline resin (also referred to as amorphous resin), but introduction of a resin having a vinyl polymerized segment has been investigated from the viewpoint of cost as a non-crystalline binder resin and a decrease in amount of the solvent used at the time of manufacture (JP 2015-007692 A).

However, the toner which uses an amorphous resin having a vinyl polymerized segment and a crystalline resin and is disclosed in JP 2015-007692 A has a problem that the fatty acid metal salt particles inhibit melting of the toner (base particles) and the fold fixability deteriorates in the case of attempting to secure the cleaning property through external addition of the fatty acid metal salt particles (lubricant) described in JP 2015-163950 A.

SUMMARY OF THE INVENTION

Accordingly, an object of the present invention is to provide a toner for developing an electrostatic latent image which exhibits both excellent low temperature fixability (fold fixability) and excellent cleaning property (suppression of slipping through of external additives).

The present inventors have carried out intensive investigations in view of the above problem. As a result, it has been found out that the problem can be solved by a toner for developing an electrostatic latent image which contains toner base particles containing a hybrid crystalline polyester resin and an amorphous resin as a binder resin and at least fatty acid metal salt particles (lubricant) having a specific particle diameter as an external additive, whereby the present invention has been completed.

In other words, the above object according to the present invention can be achieved by the following aspects.

1. To achieve the abovementioned object, according to an aspect, a toner for developing an electrostatic latent image reflecting one aspect of the present invention comprises: toner base particles containing a hybrid crystalline polyester resin having a crystalline polyester polymerized segment and an amorphous polymerized segment chemically bonded to each other and an amorphous resin; and an external additive including fatty acid metal salt particles, wherein a volume median diameter of the fatty acid metal salt particles is from 3.0 to 5.0 μm.

2. The toner for developing an electrostatic latent image of Item. 1, wherein a content of the amorphous polymerized segment in the hybrid crystalline polyester resin is preferably from 0.1 to 30% by mass.

3. The toner for developing an electrostatic latent image of Item. 1 or 2, wherein the hybrid crystalline polyester resin is preferably contained in the toner base particles at 5 to 30% by mass.

4. The toner for developing an electrostatic latent image of any one of Items. 1 to 3, wherein a content of the amorphous resin is preferably in a range of 20 to 99% by mass with respect to the entire amount of the toner base particles.

5. The toner for developing an electrostatic latent image of any one of Items. 1 to 4, wherein the amorphous polymerized segment is preferably a vinyl polymerized segment, and the amorphous resin is preferably a vinyl resin.

6. The toner for developing an electrostatic latent image of any one of Items. 1 to 5, wherein an adhesive strength of the fatty acid metal salt particles is preferably from 40 to 70%.

7. The toner for developing an electrostatic latent image of any one of Items. 1 to 6, wherein the external additive preferably includes an external additive other than the fatty acid metal salt particles, and the external additive having the largest number average primary particle diameter among the external additives other than the fatty acid metal salt particles is preferably inorganic fine particles having a number average primary particle diameter of from 60 to 200 nm.

8. To achieve the abovementioned object, according to an aspect, a toner for developing an electrostatic latent image reflecting one aspect of the present invention is provided, wherein the inorganic fine particles of Item. 7 are silica particles.

9. To achieve the abovementioned object, according to an aspect, a two-component developer for developing an electrostatic latent image reflecting one aspect of the present invention comprises: the toner for developing an electrostatic latent image of any one of Items. 1 to 8; and carrier particles.

10. To achieve the abovementioned object, according to an aspect, a two-component developer for developing an electrostatic latent image reflecting one aspect of the present invention is provided, wherein the carrier particles of Item. 9 are coated type carrier particles having core material particles and a layer of a coating material (carrier coating resin) to coat a surface of the core material particles.

DESCRIPTION OF THE PREFERRED EMBODIMENTS

Hereinafter, an embodiment of the present invention will be described with reference to the drawings. However, the scope of the invention is not limited to the illustrated examples. In addition, the term "X to Y" indicating the range means "X or more and Y or less" in the present specification. In addition, the operations and measurements of physical properties and the like are conducted at room temperature (20 to 25° C.)/relative humidity of from 40 to 50% RH unless otherwise stated.

[I] Toner for Developing Electrostatic Latent Image

A first embodiment of the present invention is a toner for developing an electrostatic latent image which contains toner base particles containing a hybrid crystalline polyester resin in which a crystalline polyester polymerized segment and an amorphous polymerized segment are chemically bonded to each other and an amorphous resin and an external additive including fatty acid metal salt particles, and in which the volume median diameter of the fatty acid metal salt particles is from 3.0 to 5.0 μm. The effect of an embodiment of the present invention described above can be effectively exerted as the toner of an embodiment of the present invention has the configuration described above.

The mechanism of exertion or action of the above effect by the toner of an embodiment of the present invention is not clarified, but it is presumed as follows.

Fatty acid metal salt particles (hereinafter, also simply referred to as the lubricant) are externally added (attached) to toner base particles for the purpose of improving the cleaning property. In the case of externally adding a lubricant having a small particle diameter (in a case in which the particle diameter of the lubricant is smaller than 3 μm) as in the known example (JP 2015-163950 A), the toner and the lubricant (toner in which a lubricant or the like is externally added (attached) to the surface of the toner base particles) move on the electrophotographic process to form a fixed image. When the toner (base particles) and the lubricant are melted and fixed together, the lubricant exists at the interface between the toner base particles to hinder fusion of the toner base particles, thus a fracture surface is likely to be formed when the image is bent and the fold fixability (low temperature fixability) deteriorates. The reason for this is presumed as follows. The number of lubricant increases when the particle diameter of the lubricant is smaller, the lubricant is more likely to exist between toners (base particles) on the image, and the folding strength is weakened.

In order to prevent the lubricant from moving onto the image, a means to lower the adhesive strength thereof to the toner (base particles) is conceivable, but in the case of a lubricant having a small particle diameter, the amount thereof supplied from the toner to the image portion is insufficient, so that not only the cleaning property is disadvantageous in a machine having a high process speed but also the lubricant having a small particle diameter is likely to be developed in the image background portion. At that time, cleaning property at the toner image portion deteriorates in the case of outputting the image in a vertical band. Especially, the slipping through of the external additive becomes remarkable, and the difference in amount of the applied lubricant becomes the difference in surface potential and it comes out as the difference in image density when a solid image is output. In a case in which the particle diameter of the lubricant is increased (when the particle diameter of the lubricant is larger than 5 μm), the same thing occurs as the lubricant on the toner base particles is individually developed on the image background portion as positively charged particles.

Meanwhile, a crystalline resin is introduced for low temperature fixability, but it is compatible with an amorphous resin and causes a decrease in glass transition temperature (Tg) of the amorphous resin. It is possible to increase the image intensity by suppressing this, and it is thus important that the crystalline resin rapidly crystallizes (incompatible state) at the time of fixing. The crystalline polyester resin and the amorphous resin are likely to be in an incompatible state at the time of fixing due to the structural factor. At this time, the crystalline polyester resin exhibits orientation with respect to the amorphous resin when the crystalline polyester resin partially has an amorphous polymerized segment (hybridized), and it is thus presumed that the crystallization of the resin is promoted. In addition, the interaction between the amorphous polymerized segment belonging to the hybrid crystalline polyester resin and the amorphous resin (preferably having the same kind of composition) is intensified and the image intensity against bending can be further improved.

As described above, it is possible to intensify the interaction between the crystalline resin and the amorphous resin, to enhance the fold fixability, and to maintain the low temperature fixability by hybridizing the crystalline resin from the viewpoint of the inside of toner, and it is possible to promote the coalescence of toners at the time of fixing and to improve the cleaning property (suppression of slipping through of the external additive) while increasing the fold fixability and further to suppress the image defects due to slipping through of the external additive by setting the particle diameter of the lubricant to from 3 to 5 μm from the viewpoint of structure of the toner interface. As described above, it has been succeeded in solving the problem of the prior art that it is difficult to achieve both low temperature fixability (fold fixability) and cleaning property (suppression of slipping through of external additives and further suppression of image defects due to slipping through of external additives).

Incidentally, the mechanism of exertion or action described above is based on presumption, and the present invention is not limited to the above mechanism at all.

Hereinafter, the toner for developing an electrostatic latent image of an embodiment of the present invention will be described in detail. Incidentally, the toner for developing an electrostatic latent image according to an embodiment of the present invention contains "toner base particles" as described above. The "toner base particles" are called "toner particles" as an external additive (at least the fatty acid metal salt particles (lubricant) described above) is externally added (attached) to the surface of the toner base particles. Moreover, the term "toner" refers to an aggregate of the "toner particles".

[Toner Base Particles]

The toner base particles constitute the base of the toner particles. The toner base particles according to an embodiment of the present invention contains a hybrid crystalline polyester resin in which a crystalline polyester polymerized segment and an amorphous polymerized segment are chemically bonded to each other and an amorphous resin. These resins are used as a binder resin. In addition, the toner base particles may contain other constitutional components (internal additives) such as a releasing agent (wax), a coloring agent, and a charge control agent if necessary.

The method of manufacturing the toner base particles of an embodiment of the present invention is not particularly limited, and examples thereof may include known methods such as a kneading pulverization method, a suspension polymerization method, an emulsion aggregation method (emulsion polymerization association method), a dissolution suspension method, a polyester elongation method, and a dispersion polymerization method. Among them, a build-up type toner base particle manufacturing method such as an emulsion polymerization association method rather than a pulverization method or a suspension polymerization (method) is preferable from the viewpoint of decreasing the particle diameter of the toner (base particles) and controllability of the circularity.

<Binder Resin>

The toner base particles of an embodiment of the present invention contain the hybrid crystalline polyester resin and the amorphous resin of a binder resin as an essential component.

[Amorphous Resin]

The amorphous resin contained in the toner base particles of an embodiment of the present invention constitutes a binder resin together with the hybrid crystalline polyester resin. The amorphous resin is a resin which does not have a melting point but has a relatively high glass transition temperature (Tg) when being subjected to differential scanning calorimetry (DSC).

When the glass transition temperature in the first temperature raising process is denoted as $Tg_1$ and the glass transition temperature in the second temperature raising process is denoted as $Tg_2$ in the DSC measurement, $Tg_1$ of the amorphous resin is preferably from 35 to 80° C. and particularly preferably from 45 to 65° C. from the viewpoint of reliably obtaining fixability such as low temperature fixability and heat resistance such as heat resistant storage stability and blocking resistance. In addition, $Tg_2$ of the amorphous resin is preferably from 20 to 70° C. and particularly preferably from 30 to 55° C. from the same point of view as the above.

The content of the amorphous resin is not particularly limited, but it is preferably from 20 to 99% by mass with respect to the entire amount (set to 100% by mass) of the toner base particles from the viewpoint of image intensity. Furthermore, the content of the amorphous resin is more preferably from 30 to 95% by mass and particularly preferably from 40 to 90% by mass with respect to the entire amount of the toner base particles. Incidentally, in a case in which two or more kinds of resins are contained as the amorphous resin, the entire amount thereof is preferably in the above content range with respect to the entire amount of the toner base particles. Incidentally, even in the case of using an amorphous resin (fine particles) containing a releasing agent, the releasing agent in the amorphous resin containing the releasing agent is included in the content of the releasing agent constituting the toner. The amorphous resin in the amorphous resin containing the releasing agent is included in the content of the amorphous resin constituting the toner.

The amorphous resin is preferably a resin of the same kind as the resin which contains the amorphous polymerized segment to be used in formation of the hybrid crystalline polyester resin (also referred to as the hybrid resin) to be described later. In detail, it is preferable to contain a resin component which constitutes the segment described in the section of "Amorphous Polymerized Segment" of the hybrid crystalline polyester resin to be described later. However, the amorphous resin may contain an amorphous resin other than the resin of the same kind as the resin which contains the amorphous polymerized segment to be used in formation of the hybrid crystalline polyester resin in a range in which the effect of an embodiment of the present invention is not impaired.

Here, the "resins of the same kind" means that a characteristic chemical bond is commonly contained in the repeating units. Here, the "characteristic chemical bond" follows the "polymer classification" described in the Substance and Materials Database (http://polymer.nims.go.jp/PoLyInfo/guide/jp/term_polymer.html) of the Substance and Materials Research Institute (NIMS). In other words, the chemical bonds constituting the polymers classified by total 22 kinds of polymers of polyacryl, polyamide, polyanhydride, polycarbonate, polydiene, polyester, polyhalogenolefin, polyimide, polyimine, polyketone, polyolefin, polyether, polyphenylene, polyphosphazene, polysiloxane, polystyrene, polysulfide, polysulfone, polyurethane, polyurea, polyvinyl, and other polymers are called "characteristic chemical bonds".

In addition, the "resins of the same kind" in a case in which the resin is a copolymer refers to the resins which have a common characteristic chemical bond in a case in which monomer species having the chemical bonds described above are the constitutional unit in the chemical structures of a plurality of monomer species constituting the copolymer. Hence, the resins are regarded as resins of the same kind as long as they have a characteristic chemical bond in common even in a case in which the properties of the resins themselves are different from each other or the molar component ratios of the monomer species constituting the copolymer are different from one another.

For example, a resin (or a resin segment) formed by styrene, butyl acrylate, and acrylic acid and a resin (or resin segment) formed by styrene, butyl acrylate, and methacrylic acid have at least a chemical bond constituting polyacryl and these are thus resins of the same kind. As another example, a resin (or resin segment) formed by styrene, butyl acrylate, and acrylic acid and a resin (or resin segment) formed by styrene, butyl acrylate, acrylic acid, terephthalic acid, and fumaric acid have at least a chemical bond constituting polyacryl as a chemical bond common to each other. Hence, these are resins of the same kind.

The amorphous resin is preferably a vinyl resin, a urethane resin, a urea resin, or the like, and more preferably it contains a vinyl resin. It is possible to control the crystallinity of the crystalline resin containing a hybrid resin as the amorphous resin contains a vinyl resin.

The amorphous resin is preferably a vinyl resin. This is because the main chain of the vinyl resin is constituted by a carbon chain, thus the vinyl resin is hardly mixed with a polyester resin having an ester bond in the main chain, and it is eventually possible to further suppress compatibility of the vinyl resin with the polyester polymerized segment (crystalline polyester resin) constituting the hybrid crystalline polyester resin.

As described above, it is preferable that the amorphous resin contains a vinyl resin. It is possible to control the crystallinity of the crystalline resin containing the hybrid crystalline polyester resin as the amorphous resin contains a vinyl resin. In a case in which the amorphous resin contains a vinyl resin, the content of the vinyl resin in the toner is preferably 3% by mass or more and 90% by mass or less, more preferably from 20 to 90% by mass, still more preferably from 30 to 90% by mass, and particularly preferably from 40 to 90% by mass with respect to the entire amount of the toner. It is concerned that the binder resin in the toner interacts with the surrounding constitutional material so as to be compatible or to hinder the crystallization at the time of manufacturing the toner. However, compatibility and suppression of crystallization hardly occur by a combination of the crystalline resin containing a hybrid resin and the amorphous resin since the molecular structures thereof are different from each other, and the degree of crystallinity of the crystalline resin containing a hybrid resin can be controlled by containing a vinyl resin. Among the resins having different compositions from that of the crystalline resin, it is suitable to contain a vinyl resin from the viewpoint of image intensity and melt viscosity. Furthermore, a vinyl resin is excellent since preferred crystallinity can be secured when the content thereof is in the above range (3% by mass or more and 90% by mass or less). From the above point of view, the content of the vinyl resin in the toner is more preferably 40% by mass or more and 75% by mass or less with respect to the entire amount of the toner.

Furthermore, in a case in which the amorphous resin contains an amorphous polyester resin other than the vinyl resin, the content of the amorphous polyester resin in the toner is preferably 40% by mass or lass (more than 0% by mass) with respect to the entire amount of the toner. This is because the crystalline resin containing a hybrid resin, the amorphous resin having a vinyl resin, and the releasing agent form a domain phase in the toner, but the degree of crystallinity of the crystalline resin containing a hybrid resin is affected by the compositions of surrounding resins and the respective ratios thereof. Hence, it is preferable that the amorphous resin contains an amorphous polyester resin and the content of the amorphous polyester resin in the toner is 40% by mass or less from the viewpoint of achieving improvement in low temperature fixability since it is possible to suppress an increase in affinity between the crystalline resin containing a hybrid resin and the amorphous polyester resin and to suppress a decrease in degree of crystallinity of the crystalline resin containing a hybrid resin. The content of the amorphous polyester resin in the toner is more preferably 5% by mass or more and 30% by mass or less with respect to the entire amount of the toner from the viewpoint of improvement in low temperature fixability.

The vinyl resin is suitable from the viewpoint of easily controlling the compatibility with a hybrid resin particularly in a case in which the amorphous polymerized segment of the hybrid resin is a vinyl polymerized segment. Hereinafter, the vinyl resin will be described.

(Vinyl Resin)

The vinyl resin is a resin obtained through polymerization using at least a vinyl monomer. The vinyl resin is not particularly limited as long as it is one obtained by polymerizing a vinyl compound, but examples thereof may include an acrylic acid ester resin, a styrene-acrylic acid ester resin, and an ethylene-vinyl acetate resin. These may be used singly or in combination of two or more kinds thereof.

Specific examples of the amorphous vinyl resin may include an acrylic resin and a styrene-acrylic resin. Among them, a styrene-acrylic acid ester resin (styrene-acrylic resin) formed by using a styrene monomer and a (meth) acrylic acid ester monomer is preferable as the amorphous vinyl resin in consideration of the plasticity at the time of thermal fixation.

The styrene-(meth) acrylic resin is formed through addition polymerization of at least a styrene monomer and a (meth)acrylic acid ester monomer. The styrene monomer referred to herein includes those that have a structure having a known side chain or functional group in the styrene structure in addition to a styrene represented by a structural formula of $CH_2{=}CH{-}C_6H_5$. In addition, the (meth)acrylic acid ester monomer referred to herein includes ester compounds having known side chains or functional groups in the structures such as acrylic acid ester derivatives and methacrylic acid ester derivatives in addition to an acrylic acid ester compound and a methacrylic acid ester compound represented by $CH_2{=}CHCOOR$ (R is an alkyl group). Incidentally, the "(meth)acrylic acid ester monomer" is a general term for an "acrylic acid ester monomer" and a "methacrylic acid ester monomer" in the present specification.

The method of manufacturing the styrene-(meth)acrylic resin is not particularly limited, and examples thereof may include a method in which the polymerization is conducted by using an arbitrary polymerization initiator such as a peroxide, a persulfide, a persulfate, or an azo compound, which is usually used in the polymerization of the above monomer by a known polymerization technique such as bulk polymerization, solution polymerization, an emulsion polymerization method, a mini-emulsion method, or a dispersion polymerization method. In addition, a generally used chain transfer agent can be used for the purpose of adjusting the molecular weight. The chain transfer agent is not particularly limited, and examples thereof may include an alkyl mercaptan such as n-octyl mercaptan or a mercapto fatty acid ester.

In the case of using an amorphous vinyl resin (particularly styrene-acrylic resin), the proportion of the amorphous vinyl resin (particularly styrene-acrylic resin) is preferably in a range of 55 to 85% by mass of the entire toner. It is more preferably in a range of 60 to 80% by mass. It is possible to control the volume resistivity of the toner by adjusting the proportion in this range. In addition, the content of the amorphous vinyl resin (particularly styrene-(meth)acrylic resin) in the binder resin (crystalline resin+amorphous resin) is not particularly limited, but it is preferably more than 50% by mass, more preferably 70% by mass or more, and particularly preferably 90% by mass or more with respect to the total amount of the binder resin. Meanwhile, the upper limit value of the content is not particularly limited, and it is 100% by mass or less.

As the vinyl monomer forming the vinyl resin, one kind or two or more kinds selected from the following ones can be used.

(1) Styrene Monomer

Examples of the styrene monomer may include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and any derivative thereof.

(2) (Meth)acrylic Acid Ester Monomer

Examples of the (meth)acrylic acid ester monomer may include methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth) acrylate, dimethylaminoethyl (meth)acrylate, and any derivative thereof.

(3) Vinyl Ester Monomer

Examples of the vinyl ester monomer may include vinyl propionate, vinyl acetate, and vinyl benzoate.

(4) Vinyl Ether Monomer

Examples of the vinyl ether monomer may include vinyl methyl ether and vinyl ethyl ether.

(5) Vinyl Ketone Monomer

Examples of the vinyl ketone monomer may include vinyl methyl ketone, vinyl ethyl ketone, and vinyl hexyl ketone.

(6) N-Vinyl Monomer

Examples of the N-vinyl monomer may include N-vinylcarbazole, N-vinylindole, and N-vinylpyrrolidone.

(7) Others

As other kinds of monomers, a vinyl compound such as vinylnaphthalene or vinylpyridine and an acrylic acid or methacrylic acid derivative such as acrylonitrile, methacrylonitrile, or acrylamide can be used.

The content of the constitutional unit derived from (1) the styrene monomer in the vinyl resin, particularly the styrene-(meth) acrylic resin is preferably from 40 to 90% by mass with respect to the entire amount of the resin. In addition, the content of the constitutional unit derived from (2) the (meth) acrylic acid ester monomer in the resin is preferably from 10 to 60% by mass with respect to the entire amount of the resin.

In addition, as the vinyl monomer, it is preferable to use a monomer having an ionically dissociable group such as a carboxyl group, a sulfonic acid group, or a phosphoric acid group. Specific examples thereof may include the following ones.

Examples of the monomer having a carboxyl group may include acrylic acid, methacrylic acid, maleic acid, itaconic acid, cinnamic acid, fumaric acid, a monoalkyl ester of maleic acid, and a monoalkyl ester of itaconic acid. In addition, examples of the monomer having a sulfonic acid group may include styrene sulfonic acid, allyl sulfosuccinic acid, and 2-acrylamido-2-methylpropanesulfonic acid. Furthermore, examples of the monomer having a phosphoric acid group may include acidophosphoxyethyl methacrylate. The content of the constitutional unit derived from the monomer compound described above in the amorphous vinyl resin (particularly, styrene-(meth)acrylic resin) is from 0.5 to 20% by mass with respect to the entire amount of the resin.

Furthermore, a polyfunctional vinyl can be used as the vinyl monomer and the non-crystalline vinyl resin can be formed to have a crosslinked structure. Examples of the polyfunctional vinyl may include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

A method of forming the vinyl resin is not particularly limited, and examples thereof may include a method in which a monomer is polymerized by using a known oil-soluble or water-soluble polymerization initiator. As the oil-soluble polymerization initiator, specifically there are the following azo-based or diazo-based polymerization initiators and peroxide-based polymerization initiators.

Examples of the azo-based or diazo-based polymerization initiator may include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Examples of the peroxide-based polymerization initiator may include benzoyl peroxide, methyl ethyl ketone peroxide, diisopropylperoxydicarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine.

In addition, it is possible to use a water-soluble radical polymerization initiator in the case of forming resin particles by an emulsion polymerization method. Examples of the water-soluble radical polymerization initiator may include persulfates such as potassium persulfate and ammonium persulfate, azobisaminodipropane acetate salt, azobiscyanovaleric acid and any salt thereof, and hydrogen peroxide.

The glass transition temperature (Tg) of the amorphous resin is preferably in a range of 40 to 70° C. and more preferably in a range of 45 to 65° C. Sufficient low temperature fixability and heat resistant storage stability are both obtained as the glass transition temperature of the amorphous resin is in the above range.

Incidentally, the glass transition temperature (Tg) of the amorphous resin is a value measured by using the "Diamond DSC" (manufactured by PerkinElmer Co., Ltd.).

with regard to the glass transition temperature ($Tg_1$) of the amorphous resin, the DSC curve is measured by differential scanning calorimetry in conformity to ASTM D3418-8. The measurement is conducted in the same manner as the above measurement except that the temperature raising rate of 10° C./min is changed to 20° C./min, and the onset temperature to be determined from the endothermic curve obtained by the first temperature raising process is taken as the glass transition temperature $Tg_1$ (° C.).

As the measuring procedure, 3.0 mg of a sample (amorphous resin) for measurement is sealed in an aluminum pan and set in a holder. The empty aluminum pan is used as the reference. The temperature control of Heat-cool-Heat is conducted under a measurement condition having a measurement temperature in a range of 0 to 200° C., a temperature raising rate of 10° C./min, and a temperature lowering rate of 10° C./min, the analysis is conducted based on the data for the 2nd. Heat, the extended line of the base line before the first endothermic peak rises is drawn, a tangential line indicating the maximum inclination is drawn from the rising portion of the first peak to the peak top, and the intersection between the two lines is taken as the glass transition temperature.

In addition, the molecular weight of the amorphous resin (preferably vinyl resin, particularly styrene-(meth)acrylic resin) measured by gel permeation chromatography (GPC) is preferably from 5,000 to 100,000, more preferably from 10,000 to 80,000, and particularly preferably from 15,000 to 60,000 as the weight average molecular weight (Mw) from the viewpoint of controlling plasticity. In an embodiment of the present invention, the molecular weight of the amorphous resin by GPC is a value measured as follows. In other words, tetrahydrofuran (THF) as a carrier solvent is allowed to flow at a flow rate of 0.2 mL/min by using an apparatus "HLC-8120 GPC" (manufactured by Tosoh Corporation) (or an apparatus having equivalent performance) and a column "TSK guard column+TSKgel SuperHZ-M3 series" (manufactured by Tosoh Corporation) (or a column having equivalent performance) while maintaining the column temperature at 40° C., the sample (amorphous resin) for measurement is dissolved in tetrahydrofuran so as to have a concentration of 1 mg/mL under a dissolution condition in which the treatment is conducted at room temperature for 5 minutes by using an ultrasonic dispersing machine, subsequently, a sample solution is obtained by treating the solution thus obtained with a membrane filter having a pore size of 0.2 μm, 10 μL of this sample solution is injected into the apparatus together with the carrier solvent and detected by using a refractive index detector (RI detector), and the molecular weight distribution of the sample for measurement is calculated by using the calibration curve measured by using monodisperse polystyrene standard particles. Ten samples are used as polystyrene for measuring the calibration curve.

[Crystalline Resin]

The toner base particles constituting the toner according to an embodiment of the present invention contain a hybrid crystalline polyester resin and an amorphous resin. Between these, the hybrid crystalline polyester resin is a resin in which a crystalline polyester polymerized segment and an amorphous polymerized segment are chemically bonded to each other, and it is a kind of crystalline resin. Incidentally, the toner base particles may contain another crystalline resin (for example, crystalline polyester resin) other than the hybrid crystalline polyester resin described above.

Incidentally, a crystalline resin is a resin which has a clear endothermic peak but not a stepwise endothermic change in differential scanning calorimetry (DSC). Specifically, the clear endothermic peak means a peak which has a half value width of the endothermic peak within 15° C., for example, when being measured at a temperature raising rate of 10° C./min in differential scanning calorimetry (DSC). In an embodiment of the present invention, as the crystalline resin, an unmodified polyester resin, a modified polyester resin, and the like may be concurrently used in addition to the hybrid resin as long as it is a resin exhibiting the thermal properties described above. The hybrid resin and other crystalline polyester resins are excellent since they are likely to take a highly crystalline structure.

(Hybrid Crystalline Polyester Resin (Hybrid Resin))

The toner base particles constituting the toner according to an embodiment of the present invention contain a hybrid crystalline polyester resin (also referred to as the hybrid resin) in which a crystalline polyester polymerized segment and an amorphous polymerized segment are chemically bonded to each other as an essential component. By using a resin in such a form, the crystalline resin and the amorphous resin are likely to be mixed with each other and the compatibility therebetween increases in the binder resin, and as a result, the low temperature fixability of the toner is favorably maintained. In addition, by using such a hybrid resin, it is likely to obtain an effect by the phase-separated structure of the binder resin (crystalline resin+amorphous resin) described above. As the binder resin has a phase-separated structure, the hybrid resin (crystalline resin) is not excessively exposed to the toner surface and the hot offset property is favorable even when the hybrid resin (crystalline resin) and the amorphous resin are compatible at the time of melting of the toner. It is preferable that the crystalline polyester polymerized segment and the amorphous polymerized segment are formed by being chemically bonded to each other via a dual reactive monomer. Incidentally, the crystalline polyester polymerized segment is constituted by a crystalline polyester resin.

It is preferable that the hybrid crystalline polyester resin is contained in the toner base particles in a range of 5 to 30% by mass (Examples: 5 to 30% by mass). It is possible to avoid the presence of a polyester resin of which the crystal growth is not completed when the content of the hybrid crystalline polyester resin in the toner base particles is 30% by mass or less. Hence, it is preferable since the crystal growth at the time of fixing can be sufficiently promoted. Meanwhile, it is preferable that the content of the hybrid crystalline polyester resin in the toner base particles is 5% by mass or more since a sufficient amount of hybrid crystalline polyester resin required for the crystallization can be secured and, as a result, crystal growth at the time of fixing can be sufficiently promoted.

The crystalline polyester polymerized segment refers to a moiety derived from a crystalline polyester resin. In other words, it refers to a molecular chain having the same chemical structure as that constituting the crystalline polyester resin. In addition, the amorphous polymerized segment refers to a moiety derived from an amorphous resin (other than a polyester resin). In other words, it refers to a molecular chain having the same chemical structure as that constituting the amorphous resin (other than polyester resin).

The bonding form of the hybrid resin is not particularly limited. For example, the hybrid resin may be in a block copolymerized form (block copolymer) having a crystalline polyester polymerized segment and an amorphous polymerized segment or a form (graft copolymer) in which the side chain by a crystalline polyester polymerized segment is bonded to the main chain by an amorphous polymerized segment, or a reverse form thereof. Among them, the hybrid resin is preferably a graft copolymer in which the main chain is an amorphous polymerized segment and the side chain is a crystalline polyester polymerized segment. In other words, the hybrid resin is preferably a graft copolymer having a comb structure in which an amorphous polymerized segment is the backbone and a crystalline polyester polymerized segment is a branch.

As the hybrid resin is such a graft copolymer, the crystalline polyester polymerized segment is likely to be densely oriented as well as the orientation of the crystalline polyester polymerized segment is likely to be aligned in one direction, and it is thus possible to impart sufficient crystallinity to the hybrid resin. As a result, the crystallinity of the binder resin (crystalline resin+amorphous resin) in the toner is improved. Hence, the toner according to an embodiment of the present invention exhibits excellent low temperature fixability.

The weight average molecular weight (Mw) of the hybrid resin is preferably from 3,000 to 100,000, more preferably from 4,000 to 50,000, and particularly preferably from 5,000 to 30,000 from the viewpoint of reliably achieving both sufficient low temperature fixability and excellent heat resistant storage stability. In addition, the number average molecular weight (Mn) thereof is preferably from 3,000 to 100,000, more preferably from 4,000 to 50,000, and particularly preferably from 5,000 to 20,000.

Incidentally, a substituent such as a sulfonic acid group, a carboxyl group, or a urethane group may be introduced into the hybrid resin to be contained in the toner base particles. The substituent may be introduced into the crystalline polyester polymerized segment or the amorphous polymerized segment other than the crystalline polyester polymerized segment.

The melting point Tm of the hybrid resin to be contained in the toner base particles is preferably in a range of 60 to 90° C. and more preferably in a range of 65 to 85° C. It is excellent that Tm is 60° C. or higher since heat resistant storage stability can be secured. Meanwhile, it is excellent that Tm is 90° C. or lower since sufficient low temperature fixability can be obtained.

<<Crystalline Polyester Polymerized Segment (Crystalline Polyester Resin)>>

The crystalline polyester polymerized segment constituting the hybrid resin is the same as the crystalline polyester resin, and it is a moiety derived from a known polyester resin obtained by a polycondensation reaction of a polycarboxylic acid with a polyhydric alcohol. In other words, it is constituted by a crystalline polyester resin manufactured by conducting a polycondensation reaction of a polycarboxylic acid with a polyhydric alcohol in the presence of a catalyst. The crystalline polyester polymerized segment is not particularly limited as long as it is as defined above. For example, with regard to a resin having a structure in which another component is copolymerized to the main chain by a crystalline polyester polymerized segment or a resin having a structure in which a crystalline polyester polymerized segment is copolymerized to the main chain composed of another component, the toner containing this resin can be said to contain the hybrid resin having the crystalline polyester polymerized segment according to an embodiment of the present invention as long as the toner has a clear endothermic peak as described above. In addition, the crystalline polyester resin which can be used as the crystalline resin other than the hybrid resin is a known polyester resin obtained by a polycondensation reaction of a polycarboxylic acid with a polyhydric alcohol.

A polycarboxylic acid is a compound having two or more carboxyl groups in one molecule, and it is possible to use an alkyl ester, an acid anhydride, and an acid chloride of a polycarboxylic acid compound. As the polycarboxylic acid compound, for example, a dicarboxylic acid such as oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p, p'-dicarboxylic acid, naphthalene-1,4-dicarboxylic acid, naphthalene-1,5-dicarboxylic acid, naphthalene-2,6-dicarboxylic acid, anthracenedicarboxylic acid, or dodecenylsuccinic acid; may be combined with a tri- or higher carboxylic acid such as trimellitic acid, pyromellitic acid, naphthalenetricarboxylic acid, naphthalenetetracarboxylic acid, pyrenetricarboxylic acid, or pyrenetetracarboxylic acid.

The polyhydric alcohol compound is a compound having two or more hydroxyl groups in one molecule, and examples of the polyhydric alcohol compound may include a dihydric alcohol such as ethylene glycol, propylene glycol, butanediol, diethylene glycol, hexanediol, cyclohexanediol, octanediol, decanediol, dodecanediol, ethylene oxide adduct of bisphenol A, or propylene oxide adduct of bisphenol A; and a trihydric or higher polyol such as glycerin, pentaerythritol, hexamethylolmelamine, hexaethylolmelamine, tetramethylolbenzoguanamine, or tetraethylolbenzoguanamine.

As a catalyst for synthesizing the crystalline polyester polymerized segment (or crystalline polyester resin), various catalysts known in the prior art can be used, and for example, an esterification catalyst can be used.

Examples of the esterification catalyst may include a tin compound such as dibutyltin oxide or tin(II) 2-ethylhexanoate and a titanium compound such as titanium diisopropylate bistriethanolaminate, and examples of the esterification promoter may include gallic acid. The amount of the esterification catalyst used is preferably from 0.01 to 1.5 parts by mass and more preferably from 0.1 to 1.0 part by mass with respect to 100 parts by mass of the total amount of the polyhydric alcohol, the polycarboxylic acid, and the dual reactive monomer component. The amount of the esterification promoter used is preferably from 0.001 to 0.5 part by mass, more preferably from 0.01 to 0.1 part by mass with respect to 100 parts by mass of the total amount of the polyhydric alcohol, the polycarboxylic acid, and the dual reactive monomer component.

Examples of the combination of a polycarboxylic acid with a polyhydric alcohol for forming the crystalline polyester polymerized segment (or crystalline polyester resin) usable in an embodiment of the present invention may include 1,12-dodecanediol (12 carbon atoms) with sebacic acid (10 carbon atoms), ethylene glycol (2 carbon atoms) with sebacic acid (10 carbon atoms), 1,6-hexanediol (6 carbon atoms) with dodecanedioic acid (12 carbon atoms), 1,9-nonanediol (9 carbon atoms) with dodecanedioic acid (12 carbon atoms), and 1,6-hexanediol (6 carbon atoms) with sebacic acid (10 carbon atoms).

(Method of Measuring Melting Point of Hybrid Crystalline Polyester Resin (or Polyester Resin to be Used in Formation of Crystalline Polyester Polymerized Segment))

The melting point of the hybrid crystalline polyester resin (or the polyester resin to be used in formation of the crystalline polyester polymerized segment) can be measured by using a differential scanning calorimeter (DSC).

For example, the measurement can be conducted by using a differential scanning calorimeter DSC-7 (manufactured by PerkinElmer Co., Ltd.) and a thermal analyzer controller TAC7/DX (manufactured by PerkinElmer Co., Ltd.). Specifically, 4.50 mg of the sample is sealed in an aluminum pan (KIT No. 0219-0041), this is set in the sample holder of the "DSC-7", the empty aluminum pan is used for the measurement of reference, the temperature control of Heat-Cool-Heat is conducted under the measurement condition having a measurement temperature from 0 to 200° C., a temperature raising rate of 10° C./min, and a temperature lowering rate of 10° C./min, and the data for the 2nd. Heat is acquired. The temperature of the peak top of the endothermic peak is taken as the melting point.

Incidentally, the method of measuring the melting point of the hybrid crystalline polyester resin (or the polyester resin to be used in formation of the crystalline polyester polymerized segment) can also be applied as the method of measuring the melting point of the crystalline resin (crystalline polyester resin or the like) other than the hybrid crystalline polyester resin (or the polyester resin to be used in formation of the crystalline polyester polymerized segment) in the same manner.

<<Amorphous Polymerized Segment>>

The amorphous polymerized segment other than the crystalline polyester polymerized segment constituting the hybrid crystalline polyester resin contributes to the improvement in affinity between the amorphous resin and the hybrid resin in the toner base particles. The presence of the amorphous polymerized segment improves the affinity between the hybrid resin and the amorphous resin and makes it easy to control the compatibility between the hybrid resin and the amorphous resin. The amorphous polymerized segment is constituted by a resin obtained by polymerizing a monomer forming an amorphous resin. Here, the monomer forming an amorphous resin is not particularly limited, and for example, a known monomer such as the vinyl monomer which constitutes the vinyl resin and is described above can be used.

In addition, the content (hybrid ratio) of the amorphous polymerized segment other than the crystalline polyester polymerized segment in the hybrid crystalline polyester resin is preferably in a range of 0.1 to 30% by mass. A more preferred range of the content is a range of 0.5 to 20% by mass. An effect of promoting the crystallization is more easily obtained when the content is 0.1% by mass or more. In addition, an effect of promoting the crystallization is more easily obtained in the same manner since an increase in compatibility is suppressed when the content is 30% by mass or less.

Incidentally, the hybrid ratio is the proportion (% by mass) of the amorphous polymerized segment in the hybrid crystalline polyester resin (the entire amount of the structure derived from the crystalline polyester polymerized segment, the amorphous polymerized segment, and the dual reactive monomer).

[Dual Reactive Monomer]

The "dual reactive monomer" is a monomer which bonds the crystalline polyester polymerized segment with the amorphous polymerized segment, and it is a monomer having both a group which is selected from a hydroxyl group, a carboxyl group, an epoxy group, a primary amino group, or a secondary amino group and forms the crystalline polyester polymerized segment and an ethylenically unsaturated group forming the amorphous polymerized segment in the molecule. The dual reactive monomer is preferably a monomer having a hydroxyl group or a carboxyl group and an ethylenically unsaturated group. Still more preferably, it is a monomer having a carboxyl group and an ethylenically unsaturated group. In other words, it is preferably vinyl-based carboxylic acid.

Specific examples of the dual reactive monomer may include acrylic acid, methacrylic acid, fumaric acid, and maleic acid, and the dual reactive monomer may be any hydroxyalkyl (1 to 3 carbon atoms) ester of these, but it is preferably acrylic acid, methacrylic acid, or fumaric acid from the viewpoint of reactivity. The crystalline polyester polymerized segment and the amorphous polymerized segment are chemically bonded to each other via this dual reactive monomer.

The amount of the dual reactive monomer used is preferably from 1 to 10 parts by mass and more preferably from 4 to 8 parts by mass with respect to 100 parts by mass of the total amount of the monomers constituting the amorphous polymerized segment from the viewpoint of improving the low temperature fixability, high temperature offset resistance, and durability of the toner.

[Method of Manufacturing Hybrid Crystalline Polyester Resin]

As the method of manufacturing the hybrid crystalline polyester resin, an existing general scheme can be used. Examples of the representative method may include the following three methods.

(1) A method in which a crystalline polyester polymerized segment is polymerized in advance, a dual reactive monomer is reacted with the crystalline polyester polymerized segment, and a monomer (for example, an aromatic vinyl monomer and a (meth) acrylic acid ester monomer) for forming an amorphous polymerized segment is further reacted with the resultant, whereby the hybrid crystalline polyester resin is formed;

(2) A method in which an amorphous polymerized segment is polymerized in advance, a dual reactive monomer is reacted with the amorphous polymerized segment, and a polycarboxylic acid and a polyhydric alcohol for forming a crystalline polyester polymerized segment are further reacted with the resultant, whereby the hybrid crystalline polyester resin is formed; and (3) A method in which a crystalline polyester polymerized segment and an amorphous polymerized segment are polymerized in advance, respectively, and a dual reactive monomer is reacted with these to bond these to each other, whereby the hybrid crystalline polyester resin is formed.

In an embodiment of the present invention, any of the above manufacturing methods can be used, but the method (2) is preferable. Specifically, it is preferable that a polycarboxylic acid and a polyhydric alcohol which form a crystalline polyester polymerized segment, a monomer forming an amorphous polymerized segment, and a dual reactive monomer are mixed together, the addition polymerization between the monomer forming an amorphous polymerized segment and the dual reactive monomer is conducted by adding a polymerization initiator to the mixture to form an amorphous polymerized segment, and the polycondensation reaction is then conducted by adding an esterification catalyst to the resultant, whereby a hybrid crystalline polyester resin is formed.

Here, as a catalyst for synthesizing the crystalline polyester polymerized segment, various catalysts known in the prior art can be used. In addition, examples of the esterification catalyst may include a tin compound such as dibutyltin oxide and tin(II) 2-ethylhexanoate and a titanium compound such as titanium diisopropylate bistriethanolaminate, and examples of the esterification promoter may include gallic acid (3,4,5-trihydroxybenzoic acid).

<Other Constitutional Components>

The toner base particles to be used in an embodiment of the present invention may contain internal additives such as a coloring agent, a releasing agent (wax), and a charge control agent in addition to the binder resin containing a hybrid crystalline polyester resin and an amorphous resin described above.

<Coloring Agent>

As the coloring agent to be contained in the toner base particles of an embodiment of the present invention, a known inorganic or organic coloring agent can be used. As the coloring agent, various kinds of organic and inorganic pigments and dyes and the like can be used in addition to carbon black and a magnetic powder. As carbon black, channel black, furnace black, acetylene black, thermal black, lamp black, and the like are used. As the magnetic material, ferromagnetic metals such as iron, nickel, and cobalt, alloys containing these metals, compounds of ferromagnetic metals such as ferrite and magnetite, alloys which do not contain a ferromagnetic metal but exhibit ferromagnetism through a heat treatment, for example, alloys of a kind called Heusler alloy such as manganese-copper-aluminum and manganese-copper-tin, chromium dioxide, and the like can be used.

As the black coloring agent, carbon black (for example, Regal 330R manufactured by Cabot Corporation as a commercially available product) such as furnace black, channel black, acetylene black, or thermal black is used, and further a magnetic powder such as magnetite or ferrite is also be used.

Examples of the coloring agent for magenta or red may include C.I. Pigment Red 2, 3, 5, 6, 7, 15, 16, 48:1, 53:1, 57:1, 60, 63, 64, 68, 81, 83, 87, 88, 89, 90, 112, 114, 122, 123, 139, 144, 149, 150, 163, 166, 170, 177, 178, 184, 202, 206, 207, 209, 222, 238, and 269.

In addition, examples of the coloring agent for orange or yellow may include C.I. Pigment Orange 31 and 43 and C.I. Pigment Yellow 12, 14, 15, 17, 74, 83, 93, 94, 138, 155, 162, 180, and 185.

Furthermore, examples of the coloring agent for green or cyan may include C.I. Pigment Blue 2, 3, 15, 15:2, 15:3, 15:4, 16, 17, 60, 62, and 66 and C.I. Pigment Green 7.

These coloring agents may be used singly or two or more of them are selected and concurrently used if necessary.

The content of the coloring agent is in a range of 1 to 30% by mass and more preferably from 2 to 20% by mass with respect to the toner base particles. It is possible to secure color reproducibility of the image when the content is in such a range.

In addition, the size of the coloring agent is from 10 to 1000 nm, preferably from 50 to 500 nm, and particularly preferably from 80 to 300 nm as a volume average particle diameter (volume median diameter). The volume average particle diameter may be the catalog value, and for example, the volume average particle diameter (volume median diameter) of the coloring agent can be measured by using the "UPA-150" (manufactured by MicrotracBell Corp.).

<Releasing Agent>

A releasing agent can be added to the toner base particles according to an embodiment of the present invention. Wax is preferably used as the releasing agent. Examples of the wax may include a hydrocarbon wax such as low molecular weight polyethylene wax, low molecular weight polypropylene wax, Fischer-Tropsch wax, microcrystalline wax, or paraffin wax and an ester wax such as carnauba wax, pentaerythritol behenic acid ester, behenyl behenate, or behenyl citrate. These may be used singly or in combination of two or more kinds thereof.

As the releasing agent (wax), it is preferable to use one having a melting point of from 50 to 95° C. from the viewpoint of reliably obtaining the low temperature fixability and releasability of the toner.

The content of the releasing agent in the toner is preferably 1% by mass or more and 30% by mass or less and more preferably 5% by mass or more and 20% by mass or less with respect to the toner base particles. The toner may further contain components other than the crystalline resin, amorphous resin, and releasing agent described above in a range in which the effect according to the present embodiment is exerted. Examples of the other components which may be contained in the toner base particles may include a coloring agent and a charge control agent.

In addition, forming a domain is preferable as the presence state of the releasing agent (wax) in the toner base particles from the viewpoint of exerting the releasing effect. By forming domains in the toner base particles (particularly the binder resin), the components are likely to exert the respective functions thereof.

The domain size of the releasing agent (wax) is preferably from 300 nm to 2 μm. A releasing effect is sufficiently obtained when the domain size is in this range.

<Charge Control Agent>

In addition, a charge control agent can be added (internally added) to the toner base particles according to an embodiment of the present invention if necessary. As the charge control agent, various known ones can be used.

As the charge control agent, various known compounds which can be dispersed in an aqueous medium can be used, and specific examples thereof may include a nigrosine-based dye, a metal salt of naphthenic acid or higher fatty acid, an alkoxylated amine, a quaternary ammonium salt compound, an azo-based metal complex, and a salicylic acid metal salt or a metal complex thereof.

The proportion of the charge control agent contained is preferably from 0.1 to 10% by mass and more preferably from 0.5 to 5% by mass with respect to the entire amount of the binder resin.

[Form of Toner Base Particles]

The form of the toner base particles according to an embodiment of the present invention is not particularly limited and, for example, it may be a so-called single layer structure (homogeneous structure which is not a core-shell type), a core-shell structure, a multilayer structure composed of three or more layers, or a domain-matrix structure.

[Volume Median Diameter of Toner Base Particles]

The particle diameter of the toner base particles constituting the toner of an embodiment of the present invention is preferably from 2 to 8 μm and more preferably from 3 to 6 μm as a volume median diameter. It is excellent that the volume median diameter of the toner base particles is 3 μm or more since sufficient fluidity can be maintained. In addition, it is excellent that the volume median diameter of the toner base particles is 8 μm or less since high image quality can be maintained. In addition, the transfer efficiency is enhanced, and thus the halftone image quality is improved and the image quality such as fine lines and dots is improved when the volume median diameter of the toner base particles is in the above range.

<Method of Measuring Volume Median Diameter of Toner Base Particles>

The volume median diameter of the toner base particles is measured and calculated by using a measuring apparatus in which a computer system equipped with data processing software "Software V 3.51" is connected to the "Multisizer 3" (manufactured by Beckman Coulter, Inc.). Specifically, 0.02 g of the sample (toner) for measurement is added to and mixed with 20 mL of a surfactant solution (for example, a surfactant solution prepared by diluting a neutral detergent containing a surfactant component with pure water 10 times for the purpose of dispersing the toner particles) and then subjected to ultrasonic dispersion for 1 minute to prepare a toner dispersion, and this toner dispersion is injected to the beaker containing the "ISOTON II" (manufactured by Beckman Coulter, Inc.) in the sample stand with a pipette until the concentration displayed on the measuring apparatus reaches 8%. Here, it is possible to obtain a reproducible measured value by setting the concentration to this concentration range. Thereafter, the count number of particles to be measured is set to 25000 and the aperture diameter is set to 100 μm in the measuring apparatus, the frequency value when a range of 2 to 60 μm that is the measurement range is divided into 256 is calculated, and the particle diameter at 50% from the larger volume integrated fraction is taken as the volume median diameter.

<Average Circularity of Toner Base Particles>

In the toner of an embodiment of the present invention, the average circularity of the toner base particles represented by the following Mathematical Formula 1 is preferably from 0.920 to 1.000 and more preferably from 0.940 to 0.995 from the viewpoint of improving the transfer efficiency.

[Mathematical Formula 1]

Average circularity=circumferential length of circle determined from equivalent circle diameter/circumferential length of particle projected image Mathematical Formula 1

Incidentally, the average circularity of the toner base particles can be measured, for example, by using an average circularity measuring apparatus "FPIA-2100" (manufactured by Sysmex Corporation). The particle projected image refers to the toner base particles. The equivalent circle diameter refers to the equivalent circle diameter of the toner base particles.

In addition, the values of the volume median diameter and average circularity of the toner base particles can also be measured by subjecting the toner sample treated (externally added) with the external additive to a separation treatment of the external additive and using the resulting toner sample as a sample. In that case, the external additive is separated by the following method.

Specifically, 4 g of the toner is wetted with 40 g of a 0.2% by mass aqueous solution of polyoxyethyl phenyl ether, the ultrasonic energy is adjusted such that the value of the ammeter which shows the vibration instruction value and is attached to the main body apparatus becomes 60 μA (50 W) and applied for 30 minutes by an ultrasonic homogenizer (for example, US-1200T manufactured by Nippon Seiki Co., Ltd., specification frequency: 15 kHz), the external additive is then washed off with a membrane filter having a pore size of 1 μm, and the toner component on the filter is taken as the target for measurement.

<<External Additive>>

It is possible to add known particles such as inorganic fine particles or organic fine particles and a lubricant to the surface of the toner base particles as external additives from the viewpoint of improving the charging performance, fluidity, or cleaning property as a toner. As these external additives, various ones may be used in combination. In an embodiment of the present invention, fatty acid metal salt particles (lubricant) having a specific particle diameter are contained as an external additive. It is possible to further improve the cleaning property and transferability by containing the fatty acid metal salt particles (lubricant) having a specific particle diameter.

[Fatty Acid Metal Salt Particles (Lubricant)]

As the fatty acid metal salt in the fatty acid metal salt particles (lubricant), a salt of a metal selected from zinc, calcium, magnesium, aluminum, or lithium is preferable. Among these, a salt of a metal such as zinc, lithium, or calcium is preferable from the viewpoint of enhancing lubricity. In addition, as the fatty acid of the fatty acid metal salt, a higher fatty acid having from 12 to 22 carbon atoms is preferable. It is possible to suppress the generation of a free fatty acid metal salt when a fatty acid having 12 or more carbon atoms is used, and the melting point of the fatty acid metal salt does not increase too high and favorable fixability is obtained when a fatty acid having 22 or less carbon atoms is used. Stearic acid is particularly preferable as the fatty acid. From the facts described above, examples of the fatty acid metal salt may include (higher) fatty acid metal salts such as a zinc, lithium, calcium, magnesium, aluminum, or copper salt of stearic acid, a zinc, manganese, iron, copper, magnesium salt of oleic acid, a zinc, copper, magnesium, or calcium salt of palmitic acid, a zinc or calcium salt of linoleic acid, and a zinc or calcium salt of ricinoleic acid.

In an embodiment of the present invention, fatty acid metal salt particles (lubricant) having a volume median diameter in a range of 3.0 to 5.0 μm are contained as an external additive. The fatty acid metal salt particles (lubricant) are added to the toner for the purpose of further improving the cleaning property and the transferability. It is not preferable that the volume median diameter of the fatty acid metal salt particles (lubricant) is less than 3.0 μm since the toner (base particles) and the lubricant move on the electrophotographic process to form a fixed image, but the lubricant exists at the interface between the toner (base) particles and prevents fusion of the toner (base) particles when the toner (base particles) and the lubricant are melted and fixed together, the lubricant is likely to be a fracture surface when the image is bent, and the fold fixability thus deteriorates. In addition, a means to lower the adhesive strength of the lubricant to the toner (base particles) is conceivable in order to prevent the fatty acid metal salt particles (lubricant) from moving onto the image, but it is not preferable that the lubricant has a small particle diameter since the amount thereof supplied is insufficient and thus not only the cleaning property is disadvantageous in a machine having a high process speed but also the lubricant having a small particle diameter is likely to be developed in the image background portion. At that time, cleaning property at the toner image portion deteriorates in the case of outputting the image in a vertical band. Especially, the slipping through of the external additive becomes remarkable, and the difference in amount of the applied lubricant becomes the difference in surface potential and it appears as the difference in image density when a solid image is output. Meanwhile, it is not preferable that the volume median diameter of the fatty acid metal salt particles (lubricant) is larger than 5.0 μm since the same thing (the above problem) (as the case in which the volume median diameter of the fatty acid metal salt particles (lubricant) is less than 3.0 μm) occurs as the fatty acid metal salt particles (lubricant) on the toner (base) particles is individually developed on the image background portion as positively charged particles. Incidentally, it is possible to separate the fatty acid metal salt particles (lubricant) from the toner through selection of the filter pore size according to the purpose or centrifugal separation in the application of the separation method of external additive described above.

As the fatty acid metal salt (particles) having the volume median diameter described above, it is possible to use the various kinds of (higher) fatty acid metal salt (particles) described above, among them, stearic acid metal salt is preferable, for example, zinc stearate, lithium stearate, calcium stearate, and the like are preferable, but zinc stearate is particularly preferable from the viewpoint of performance as a lubricant and electrostatic toner retention.

Incidentally, the fatty acid metal salt particles may contain, for example, other substances such as other metal salts in addition to the fatty acid metal salt in a range in which the exertion of the effect of an embodiment of the present invention is not inhibited.

<Method of Controlling Volume Median Diameter of Fatty Acid Metal Salt Particles (Lubricant)>

The method of controlling the volume median diameter of the fatty acid metal salt particles (lubricant) is not particularly limited, but as described in Examples, the volume median diameter of the fatty acid metal salt particles can be controlled by adjusting the cut point at the time of classification in the case of obtaining the fatty acid metal salt particles as follows. A fatty acid metal salt is produced through a reaction in a solution containing raw materials, this is taken out and dried, and the solid matter of the fatty acid metal salt thus obtained is coarsely pulverized, finely pulverized, and classified. However, the present invention is not limited to the control method described above, and it is also possible to control the volume median diameter of the fatty acid metal salt particles, for example, by a known method of synthesizing a fatty acid metal salt or the like.

<Method of Measuring Volume Median Diameter of Fatty Acid Metal Salt Particles (Lubricant)>

The volume median diameter of the fatty acid metal salt particles to be used in an embodiment of the present invention is measured in conformity to JIS-Z 8825-1 (2001), but specifically, the measuring method is as follows.

As the measuring apparatus, for example, a laser diffraction/scattering type particle size distribution measuring apparatus "LA-920" (manufactured by Horiba, Ltd.) can be used. For setting of measurement conditions and analysis of measured data, the dedicated software "HORIBA LA-920 WET (LA-920) Ver. 2.02" attached to the LA-920 can be used (an apparatus and software which have the measurement performance equivalent to these may also be used. For example, the volume median diameter can be measured by using a laser diffraction particle size measuring apparatus SALD-2100.). In addition, ion exchanged water from which impure solid matters and the like are removed in advance is used as the solvent for measurement. The measurement procedure is as follows.

(1) The batch type cell holder is attached to the LA-920.

(2) A predetermined amount of ion exchanged water is put in the batch type cell and the batch type cell is set in the batch type cell holder.

(3) The inside of the batch type cell is stirred by using the dedicated stirrer chip.

(4) The "refractive index" button on the "display condition setting" screen is pressed and the file "110A000I" (relative refractive index of 1.10) is selected.

(5) The volume basis is selected as the basis of particle diameter on the "display condition setting" screen.

(6) The warming operation is conducted for 1 hour or longer and the adjustment of optical axis, fine adjustment of optical axis, and the measurement of blank are then conducted.

(7) About 60 mL of ion exchanged water is put in a 100 mL flat bottom glass beaker. As a dispersant, about 0.3 mL of a diluted solution prepared by diluting the "Contaminon N" (a 10% by mass aqueous solution of a neutral detergent for washing precision measuring instruments which is composed of a nonionic surfactant, an anionic surfactant, and an organic builder and has a pH of 7, manufactured by Wako Pure Chemical Industries, Ltd.) with ion exchanged water about 3 times by mass is added thereto.

(8) A built-in ultrasonic dispersing machine "Ultrasonic Dispension System Tetora 150" (manufactured by Nikkaki Bios Co., Ltd.) having an electrical output of 120 W is prepared in a state in which the phases of two oscillators having an oscillation frequency of 50 kHz are shifted by 180 degrees from each other. About 3.3 L of ion exchanged water is put in the water tank of the ultrasonic dispersing machine, and about 2 mL of the Contaminon N is added into this water tank.

(9) The beaker of (7) is set in the beaker fixing hole of the ultrasonic dispersing machine, and the ultrasonic dispersing machine is operated. Thereafter, the height position of the beaker is adjusted such that the resonance state of the liquid surface of the aqueous solution in the beaker becomes the highest.

(10) About 1 mg of fatty acid metal salt-containing particles are added to the aqueous solution in the beaker little by little and dispersed in a state of irradiating the aqueous solution in the beaker of (9) with ultrasonic waves. Thereafter, the ultrasonic dispersion treatment is continuously conducted for further 60 seconds. Incidentally, at this time, the fatty acid metal salt-containing particles form a cluster and are floated on the liquid surface in some cases, but in that case, the cluster is sunk into water by shaking the beaker and the ultrasonic dispersion is then conducted for 60 seconds. In addition, the water temperature in the water tank is appropriately adjusted to 10° C. or higher and 40° C. or lower upon the ultrasonic dispersion.

(11) The aqueous solution which is prepared in (10) and in which the fatty acid metal salt-containing particles are dispersed is immediately added to the batch type cell little by little while paying attention so that bubbles are not formed to adjust the transmittance of light from the tungsten lamp to from 90 to 95%. Thereafter, the particle size distribution is measured. The volume median diameter is calculated based on the volume particle size distribution data thus obtained.

<Adhesive Strength of Fatty Acid Metal Salt Particles (Lubricant)>

The adhesive strength of the fatty acid metal salt particles (lubricant) having the volume median diameter is preferably in a range of 40 to 70%. In an embodiment of the present invention, it is more preferable that the adhesive strength of the fatty acid metal salt particles (lubricant) having the volume median diameter is controlled in the above range since it is possible to eliminate the difference in amount of lubricant coated (difference in amount of lubricant supplied) by controlling the component which moves together with the toner (base particles) and the component which moves to the background portion and to suppress image defects by suppressing slipping through of the external additive in the case of continuously outputting a vertical band. From the above point of view, the adhesive strength of the fatty acid metal salt particles (lubricant) having the volume median diameter is more preferably in a range of 45 to 60%.

<Method of Controlling Adhesive Strength of Fatty Acid Metal Salt Particles (Lubricant)>

The method of controlling the adhesive strength of the fatty acid metal salt particles (lubricant) is not particularly limited, but as described in Examples, in the case of fabricating a toner by adding various kinds of external additives such as a lubricant and a large-diameter external additive to the toner base particles, adding the mixture to a stirring and mixing apparatus (Henschel mixer or the like), setting the number of rotations of the stirring blade such that the circumferential velocity of the blade tip of the stirring and mixing apparatus has a predetermined value, and stirring and mixing the mixture for a predetermined time, it is possible to control the adhesive strength of the fatty acid metal salt particles, for example, by adjusting the kind, particle diameter, and the like of the toner base particles, the lubricant, the large-diameter external additive, and the like or adjusting the rotational speed of the stirring blade, the stirring and mixing time, and the temperature at the time of stirring and mixing. However, the present invention is not limited to the control method described above.

<Method of Measuring Adhesive Strength of Fatty Acid Metal Salt Particles (Lubricant)>

The adhesive strength of the fatty acid metal salt particles (lubricant) having the volume median diameter is measured by a centrifugal separation method of an aqueous dispersion of the toner. In detail, the NET intensity of the metal amount is measured by using an X-ray fluorescence spectrometer "XRF-1700" (manufactured by Shimadzu Corporation). The value thus obtained is taken as the amount of fatty acid metal salt, and the residual rate (%) in the case of being subjected to water dispersion, centrifugal separation, and a (suction) drying treatment is calculated by the following Formula (1) and taken as the adhesive strength.

[Mathematical Formula 2]

$$\text{residual rate (\%)} = (\text{amount of fatty acid metal salt in suction dried toner})/(\text{amount of fatty acid metal salt in unused toner}) \times 100 \quad \text{Formula (1)}$$

The content of the fatty acid metal salt particles (lubricant) having the volume median diameter is preferably from 0.05 to 0.60% by mass and more preferably from 0.1 to 0.3% by mass with respect to the total amount of the toner. It is excellent that the content of the fatty acid metal salt particles (lubricant) is 0.05% by mass or more since the effect of an embodiment of the present invention can be effectively exerted. It is excellent that the content of the fatty acid metal salt particles (lubricant) is 0.60% by mass or less since the effect of an embodiment of the present invention can be effectively exerted as well as inhibition of charging between the toner and the carrier due to excessive addition is suppressed.

(Other External Additives)

In an embodiment of the present invention, as the external additive, a lubricant having the particle diameter range described above (fatty acid metal salt particles having the volume median diameter described above) may be used, but it is preferable to further contain other external additives (for example, the known particles such as inorganic fine particles or organic fine particles described above) in addition to the fatty acid metal salt particles described above from the viewpoint of controlling the fluidity and chargeability of the toner particles. Other external additives may be one kind or more kinds.

Preferred examples of the inorganic fine particles may include inorganic fine particles by inorganic oxide fine particles such as silica particles, titania particles, alumina particles, zirconia particles, zinc oxide particles, chromium oxide particles, cerium oxide particles, antimony oxide particles, tungsten oxide particles, tin oxide particles, tellurium oxide particles, manganese oxide particles, and boron oxide particles; inorganic stearate compound fine particles such as aluminum stearate fine particles and zinc stearate fine particles; or inorganic titanate compound fine particles such as calcium titanate, strontium titanate, and zinc titanate; and the like. Among these, inorganic titanate compound fine particles (metal oxide fine particles) such as strontium titanate and calcium titanate are characterized by having a high polishing effect. In addition, as the silica particles, for example, silica manufactured by a wet method such as colloidal silica, a hydrolyzate of alkoxysilane (silica particles fabricated by a sol-gel method), and precipitated silica and silica manufactured by a dry method such as fumed silica and fused silica are used. It is more preferable to contain silica particles (hydrolyzate of alkoxysilane) fabricated by a sol-gel method as the external additive (inorganic fine particles). The silica particles fabricated by a sol-gel method are preferable from the viewpoint of suppressing the variation in adhesive strength of the external additives (lubricant and the like) to the toner base particles since they are characterized by having a narrow particle size distribution.

It is preferable that the surface of the inorganic fine particles (external additive) is hydrophobized. In the hydrophobization treatment, a known surface treatment agent is used. In other words, these inorganic fine particles may be subjected to a gloss treatment, a hydrophobization treatment, and the like by a known surface treatment agent such as a silane coupling agent, a titanium coupling agent (titanate-based coupling agent), an aluminate-based coupling agent, a higher fatty acid, a fatty acid metal salt, an esterified product thereof, rosin acid, or silicone oil if necessary for improvement in heat resistant storage stability, environmental stability, and the like. The surface treatment agent may be one kind or more kinds. It is preferable to use silica particles that are hydrophobized (surface treated) with hexamethyldisilazane (HMDS) or the like of a silane coupling agent from the viewpoint of improving the fluidity of the external additive.

Examples of the silane coupling agent may include dimethyldimethoxysilane, hexamethyldisilazane (HMDS), methyltrimethoxysilane, isobutyltrimethoxysilane and decyltrimethoxysilane. Examples of the silicone oil may include a cyclic compound and a linear or branched organosiloxane, and more specific examples thereof may include a cyclic compound such as organosiloxane oligomer, octamethylcyclotetrasiloxane, decamethylcyclopentasiloxane, tetramethylcyclotetrasiloxane, or tetravinyltetramethylcyclotetrasiloxane and a linear or branched organosiloxane. In addition, a highly reactive silicone oil which is obtained by introducing a modifying group into a side chain or one terminal, both terminals, one terminal of a side chain, both terminals of a side chain, and the like so that at least both terminals thereof are modified may also be used. Examples of the kind of modifying group may include alkoxy, carboxyl, carbinol, higher fatty acid modification, phenol, epoxy, methacryl, and amino, but the kind is not limited thereto. In addition, for example, it may be silicone oil having several kinds of modifying groups such as amino/alkoxy modification.

In addition, dimethyl silicone oil and these modified silicone oils, and further other surface treatment agents may be used in the surface treatment as a mixture or concurrently. Examples of the treating agent to be concurrently used may include a silane coupling agent, a titanate-based coupling agent, an aluminate-based coupling agent, various kinds of silicone oils, a fatty acid, a fatty acid metal salt, an esterified product thereof, and rosin acid.

As these inorganic fine particles, it is preferable to use spherical inorganic fine particles which are subjected to hydrophobization treatment or not and have a number average primary particle diameter of about from 5 nm to 2 μm and preferably from 60 to 200 nm. Inorganic fine particles (for example, silica particles) having a number average primary particle diameter in the above range are usually larger than other external additives. Hence, the inorganic fine particles play a role as a spacer in a two-component developer. Accordingly, the inorganic fine particles are preferable from the viewpoint of preventing other smaller external additives from being embedded in the toner base particles when the two-component developer is stirred in the developing device. In addition, the inorganic fine particles are also preferable from the viewpoint of preventing fusion of the toner base particles. Among them, the external additive contains an external additive other than the fatty acid metal salt particles, and among the external additives other than the fatty acid metal salt particles, an external additive having a maximum number average primary particle diameter (hereinafter, also referred to as a large-diameter external additive) is preferably inorganic fine particles having a number average primary particle diameter of from 60 to 200 nm and more preferably inorganic fine particles having a number average primary particle diameter of from 80 to 200 nm. In detail, this is because a large-diameter external additive is likely to desorb from the toner and to enter the tip of the blade due to a smaller diameter than the fatty acid metal salt particles (lubricant) and to cause image defects due to slipping through of external additives by inhibiting the coating effect of the lubricant. In an image forming apparatus having a coating mechanism such as a lubricant coating brush and an image forming apparatus having a charging roller, image defects are caused by slipping through of the external additive, contamination of the lubricant brush, and contamination of the charging roller in some cases. However, inorganic fine particles having a number average primary particle diameter of 60 nm or more are excellent as the large-diameter external additive since it is possible to improve the cleaning property without causing the problem described above and to exert the spacer effect. In addition, inorganic fine particles having a number average primary particle diameter of 200 nm or less are preferable as the large-diameter external additive since it is possible to effectively suppress image defects due to slipping through of the external additive without causing the problem described above. As the inorganic fine particles of the large-diameter external additive described above, hard inorganic fine particles are preferable and particularly silica (particles) is preferable as a material for those that further exert the spacer effect. In addition, the number average primary particle diameter of the inorganic fine particles can be calculated by using an electron microscopic photograph. For example, it can be determined by image processing of an image photographed by a transmission electron microscope. Alternatively, a 30,000-fold photograph of a toner sample is photographed by a scanning electron microscope, and this photographic image is captured by a scanner. The external additive present on the toner surface of the photographic image is subjected to binary processing by an image processing analyzer LUZEX (registered trademark) AP (manufactured by NIRECO), the horizontal Feret diameter of 100 particles per one kind of external additive is calculated, and the average value thereof may be taken as the number average primary particle diameter. Preferably, as described in Examples, the particle diameter is measured by using a laser diffraction/scattering type particle size distribution measuring apparatus (for example, LA-750 manufactured by Horiba, Ltd.) and the average particle diameter thereof is determined. The average particle diameter thus determined is the so-called volume average particle diameter. Incidentally, the average particle diameter is taken as the number average primary particle diameter of the inorganic fine particles in a case in which the average particle diameter of the inorganic fine particles is measured by using an electron microscope and compared with the average particle diameter determined from the measurement result by the laser diffraction/scattering type particle size distribution measuring apparatus, it is confirmed that these values are consistent with each other, it is further confirmed that aggregation of the inorganic fine particles does not occur, and it is thus judged that the average particle diameter is that of the primary particles. The number average primary particle diameter of the inorganic fine particles can be adjusted by, for example, classification or mixing of classified products.

The amount of the large-diameter external additive added is preferably from 0.1 to 3.0 parts by mass and preferably from 0.4 to 1.5 parts by mass with respect to 100 parts by mass of the toner particles. It is preferable that the amount of the large-diameter external additive added is in the above range, particularly in a range of 0.4 to 1.5 parts by mass since it is possible to decrease the adhesive property of the toner, to suppress wear and damage of the photoreceptor due to silica desorbed at the cleaning portion, and to suppress image defects.

As the inorganic fine particles, two kinds of particles (for example, silica particles) having different number average primary particle diameters may be used. For example, the number average primary particle diameter of one having a larger particle diameter is preferably from 60 to 250 nm, more preferably from 60 to 200 nm, and particularly preferably from 80 to 200 nm. It is possible to promote adhesion of the larger particles to the toner base particles and to improve the stability of the charge amount and the cleaning property when the number average primary particle diameter is in such a range. In addition, the number average primary particle diameter of one having a smaller particle diameter is preferably from 5 to 45 nm and more preferably from 12 to 40 nm. This is because it is possible to sufficiently obtain favorable chargeability of the small-diameter silica particles and to improve the stability of the initial charge amount and charge amount in a high temperature and high humidity environment by making it easier to uniformly adhere on the surface of the toner base particles when the number average primary particle diameter is in such a range.

As organic fine particles, it is possible to use spherical organic fine particles having a number average primary particle diameter of about from 10 nm to 2 μm and preferably from 60 to 200 nm. Specifically, it is possible to use organic fine particles by a homopolymer of styrene, methyl methacrylate, or the like or a copolymer thereof. Incidentally, the number average primary particle diameter of the organic fine particle can be calculated by using an electron microscopic photograph in the same manner as the number average primary particle diameter of the inorganic fine particles.

The amount of the other external additives (external additives having the particle diameter range described above other than the lubricant) added is preferably from 0.1 to 10.0 parts by mass with respect to 100 parts by mass of the toner particles.

Examples of the method of adding the external additive may include a method in which the external additive is added by using various known mixing apparatuses such as a turbulent mixer, the Henschel mixer, the Nauta mixer, and a V-type mixer.

<<Method of Manufacturing Toner>>

The method of manufacturing the toner according to an embodiment of the present invention is not particularly limited, and examples thereof may include known methods such as a kneading pulverization method, a suspension polymerization method, an emulsion aggregation method, an emulsion polymerization aggregation method (emulsion polymerization association method), a dissolution suspension method, a polyester elongation method, and a dispersion polymerization method. Among these, from the viewpoint of decreasing the particle diameter of the toner and controlling the circularity, a build-up type toner manufacturing method such as an emulsion polymerization association method rather than a pulverization method, a suspension polymerization method, and the like are preferable, and among them, an emulsion polymerization aggregation method and an emulsion aggregation method can be more suitably employed.

The emulsion polymerization aggregation method to be preferably used as the method of manufacturing the toner according to an embodiment of the present invention is a method in which the toner particles are manufactured by mixing a dispersion of fine particles of a binder resin (hereinafter, also referred to as the "binder resin fine particles") manufactured by an emulsion polymerization method with a dispersion of fine particles of a coloring agent (hereinafter, also referred to as the "coloring agent fine particles") and a dispersion of a releasing agent such as wax, aggregating the mixture until the toner particles have a desired particle diameter, and further fusing the binder resin fine particles for shape control.

In addition, the emulsion aggregation method to be preferably used as the method of manufacturing the toner according to an embodiment of the present invention is a method in which the toner particles are manufactured by adding a binder resin solution prepared by dissolving the binder resin in a solvent to a poor solvent dropwise to prepare a resin particle dispersion, mixing this resin particle dispersion with a coloring agent dispersion and a releasing agent dispersion of wax or the like, aggregating the mixture until the toner particles have a desired particle diameter, and further fusing the binder resin fine particles for shape control.

Both manufacturing methods can be applied to the toner of an embodiment of the present invention.

As the method of manufacturing the toner according to an embodiment of the present invention, an example in the case of using the emulsion polymerization aggregation method is described below.

(1) A step of preparing a dispersion in which fine particles of a coloring agent are dispersed in an aqueous medium, (2) a step of preparing a dispersion in which binder resin fine particles containing an internal additive (releasing agent, charge control agent, and the like) if necessary are dispersed in an aqueous medium, (3) a step of preparing a dispersion of binder resin fine particles through emulsion polymerization, (4) a step of forming toner base particles by mixing the dispersion of fine particles of a coloring agent and the dispersion of binder resin fine particles and aggregating, associating, and fusing the fine particles of the coloring agent and the binder resin fine particles, (5) a step of separating the toner base particles from the dispersion system (aqueous medium) of the toner base particles through filtration and removing the surfactant and the like, (6) a step of drying the toner base particles, and (7) a step of adding an external additive to the toner base particles.

In the case of manufacturing the toner by an emulsion polymerization aggregation method, the binder resin fine particles obtained by the emulsion polymerization method may have a multilayer structure of two or more layers composed of binder resins having different compositions, and the binder resin fine particles having such a constitution, for example, those having a two-layer structure, can be obtained by a technique in which a dispersion of resin particles is prepared by an emulsion polymerization treatment (first stage polymerization) according to a conventional method, a polymerization initiator and a polymerizable monomer are added to this dispersion, and this system is subjected to a polymerization treatment (second stage polymerization).

In addition, it is also possible to obtain toner particles having a core-shell structure by the emulsion polymerization aggregation method, and specifically the toner particles having a core-shell structure can be obtained by, first aggregating, associating, and fusing binder resin fine particles for core particles and fine particles of a coloring agent to fabricated core particles, subsequently adding binder resin fine particles for shell layer to the dispersion of the core particles, and aggregating and fusing the binder resin fine particles for shell layer on the surface of the core particles to form a shell layer which coats the surface of the core particles.

In addition, as the method of manufacturing the toner according to an embodiment of the present invention, an example in the case of using the pulverization method is described below.

(1) a step of mixing a binder resin, a coloring agent and, if necessary, an internal additive by using the Henschel mixer or the like, (2) a step of kneading the mixture thus obtained by using an extrusion kneader or the like while heating, (3) a step of subjecting the kneaded material thus obtained to a coarse pulverization treatment by a hammer mill or the like and then further to a pulverization treatment by a turbo mill pulverizer or the like, (4) a step of finely classifying the pulverized material thus obtained by using an air classifier utilizing the Coanda effect to form toner base particles, and (5) a step of adding an external additive to the toner base particles.

[Particle Diameter of Toner Particles]

The particle diameter of the toner particles constituting the toner of an embodiment of the present invention is preferably from 3 to 8 μm and more preferably from 3 to 6 μm, for example, as a volume median diameter. It is excellent that the particle diameter of the toner particles is 3 μm or more since it is possible to maintain sufficient fluidity. In addition, it is excellent that the particle diameter of the toner particles is 8 μm or less since it is possible to maintain high image quality.

The transfer efficiency increases and thus the halftone image quality is improved and the image quality of fine lines and dots is improved as the volume median diameter is in the above range.

The volume median diameter of the toner particles is measured and calculated by using a measuring apparatus in which a computer system for data processing (manufactured by Beckman Coulter, Inc.) is connected to the "Multisizer 3" (manufactured by Beckman Coulter, Inc.).

Specifically, 0.02 g of the toner is added to and mixed with 20 mL of a surfactant solution (for example, a surfactant solution obtained by diluting a neutral detergent containing a surfactant component with pure water 10 times for the purpose of dispersing toner particles), and subjected to the ultrasonic dispersion treatment for 1 minute to prepare a dispersion of toner particles, and this dispersion of toner particles is injected into the beaker containing the "ISOTON II" (manufactured by Beckman Coulter, Inc.) in the sample stand with a pipette until the concentration displayed on the measuring apparatus reaches from 5 to 10%. Here, it is possible to obtain a reproducible measured value by setting the concentration to this concentration range. Thereafter, the count number of particles to be measured is set to 25000 and the aperture diameter is set to 50 μm in the measuring apparatus, the frequency value when the range of 1 to 30 μm that is the measurement range is divided into 256 is calculated, and the particle diameter at 50% from the larger volume integrated fraction is taken as the volume median diameter.

<<Two-Component Developer>>

The toner according to an embodiment of the present invention can constitute a two-component developer by appropriately mixing the toner particles and carrier particles such that the content (toner concentration) of the toner particles is from 4.0 to 8.0% by mass.

Examples of mixing apparatus to be used for the mixing may include the Nauta mixer and a W cone mixer, and a V-type mixer.

[Carrier Particles]

The carrier particles are constituted by a magnetic material. Examples of the carrier particles may include coated type carrier particles having core material particles (carrier core) composed of a magnetic material and a layer of a coating material (carrier coating resin) to coat the surface of the core material particles and dispersed in resin type carrier particles in which a fine powder of a magnetic material is dispersed in a resin. The carrier particles are preferably the coated type carrier particles from the viewpoint of suppressing adhesion of the carrier particles to the photoreceptor.

<Core Material Particles (Carrier Core)>

The core material particles are composed of a magnetic material, for example, a substance that is strongly magnetized in the magnetic field direction by a magnetic field. The magnetic material may be one kind or more kinds, and examples thereof may include metals exhibiting ferromagnetism such as iron, nickel, and cobalt, alloys or compounds containing these metals, and alloys exhibiting ferromagnetism through a heat treatment.

Examples of the metals exhibiting ferromagnetism or compounds containing them may include iron, ferrite represented by the following Formula (a), and magnetite represented by the following Formula (b). M in Formulas (a) and (b) represents one or more kinds of monovalent or divalent metals selected from the group consisting of Mn, Fe, Ni, Co, Cu, Mg, Zn, Cd, and Li.

[Chemical Formula 1]

$$MO.Fe_2O_3 \quad \text{Formula (a)}$$

$$MFe_2O_4 \quad \text{Formula (b)}$$

In addition, examples of the alloys exhibiting ferromagnetism through a heat treatment may include Heusler alloys such as manganese-copper-aluminum and manganese-copper-tin and chromium dioxide.

The core material particles are preferably various kinds of ferrites. This is because the specific gravity of the coated type carrier particles is smaller than the specific gravity of the metal constituting the core material particles and the impact force by stirring in the developing device can be thus further decreased.

<Coating Material (Carrier Coating Resin)>

The coating material may be one kind or more kinds. As the coating material, a known resin to be utilized in coating of the core material particles of the carrier particles can be used. It is preferable that the coating material is a resin having a cycloalkyl group from the viewpoint of decreasing the moisture adsorption property of the carrier particles and of enhancing the adhesive property of the coating layer to the core material particles. Examples of the cycloalkyl group may include a cyclohexyl group, a cyclopentyl group, a cyclopropyl group, a cyclobutyl group, a cycloheptyl group, a cyclooctyl group, a cyclononyl group, and a cyclodecyl group. Among them, a cyclohexyl group or a cyclopentyl group is preferable, and a cyclohexyl group is more preferable from the viewpoint of adhesive property of the coating layer to the ferrite particles. The weight average molecular weight Mw of the resin is, for example, from 10,000 to 800,000 and more preferably from 100,000 to 750,000. The content of the cycloalkyl group in the resin is, for example, from 10 to 90% by mass. The content of the cycloalkyl group in the resin can be determined by, for example, pyrolysis-gas chromatography/mass spectrometry (P-GC/MS) or $^1$H-NMR.

Incidentally, the embodiments to which the present invention can be applied are not limited to the embodiments described above and can be appropriately changed without departing from the gist of the present invention.

EXAMPLES

Hereinafter, the embodiments of the present invention will be specifically described with reference to Examples, but the present invention is not limited thereto. In the following Examples, the terms "parts" and "%" mean "parts by mass" and "% by mass", respectively, unless otherwise stated, and the respective operations were conducted at room temperature (25° C.).

Example 1: Fabrication of Toner 1

[Fabrication of Amorphous Resin Fine Particle Dispersion (A1)]

(First Stage Polymerization)

In a reaction vessel equipped with a stirring device, a temperature sensor, a cooling tube, and a nitrogen introducing device, 4 parts by mass of sodium polyoxyethylene (2) dodecyl ether sulfate as a surfactant and 3000 parts by mass of ion exchanged water were put, and the internal temperature thereof was raised to 80° C. while stirring the mixture at a stirring speed of 230 rpm in a nitrogen stream. After the temperature was raised, an initiator solution in which 10 parts by mass of potassium persulfate as a polymerization initiator was dissolved in 200 parts by mass of ion exchanged water was added thereto, and the liquid temperature was set to 75° C., a monomer mixture composed of 584 parts by mass of styrene,
160 parts by mass of n-butyl acrylate, and
56 parts by mass of methacrylic acid was added thereto dropwise over 1 hour, and the polymerization was then conducted while heating and stirring the mixture at 75° C. for 2 hours, thereby preparing a dispersion of resin fine particles [a1].

(Second Stage Polymerization)

A solution prepared by dissolving 2 parts by mass of sodium polyoxyethylene (2) dodecyl ether sulfate as a surfactant in 3000 parts by mass of ion exchanged water was put in a reaction vessel equipped with a stirring device, a temperature sensor, a cooling tube, and a nitrogen introducing device, and heated to 80° C., and a solution prepared by dissolving 42 parts by mass (in terms of solid) of the resin fine particles [a1] described above and 70 parts by mass of microcrystalline wax "HNP-0190" (manufactured by NIPPON SEIRO CO., LTD.) as a releasing agent in a monomer solution composed of 239 parts by mass of styrene,
111 parts by mass of n-butyl acrylate,
26 parts by mass of methacrylic acid, and
3 parts by mass of n-octyl mercaptan (chain transfer agent)

at 80° C. was then added thereto and mixed and dispersed for 1 hour by using a mechanical dispersing machine "CLEARMIX" (manufactured by M Technique Co., Ltd.) having a circulation route, thereby preparing a dispersion containing emulsified particles (oil droplets).

Subsequently, an initiator solution prepared by dissolving 5 parts by mass of potassium persulfate as a polymerization initiator in 100 parts by mass of ion exchanged water was added to this dispersion, and this system was heated and stirred at 80° C. for 1 hour to conduct the polymerization, thereby preparing a dispersion of resin fine particles [a2].

(Third Stage Polymerization)

An initiator solution prepared by dissolving 10 parts by mass of potassium persulfate as a polymerization initiator in 200 parts by mass of ion exchanged water was further added to the dispersion of the resin fine particles [a2], and a monomer mixture composed of 380 parts by mass of styrene,
132 parts by mass of n-butyl acrylate,
39 parts by mass of methacrylic acid, and
6 parts by mass of n-octyl mercaptan (chain transfer agent)

was added thereto dropwise over 1 hour under a temperature condition of 80° C. After the dropwise addition was completed, the polymerization was conducted by heating and stirring the mixture over 2 hours, and the resultant was then cooled to 28° C., thereby obtaining a vinyl resin fine particle dispersion (A1) having an acid group as an amorphous resin particle dispersion. The volume median diameter of the vinyl resin fine particles in the vinyl resin particle dispersion (A1) thus obtained was 180 nm, and the weight average molecular weight (Mw) of the vinyl resin (amorphous resin) was 29,500.

[Fabrication of Crystalline Resin]

Synthesis Example 1: Synthesis of Hybrid Crystalline Polyester Resin [C1]

In a reaction vessel equipped with a nitrogen introduction tube, a dehydration tube, a stirrer, and a thermocouple, 274 parts by mass of sebacic acid (molecular weight of 202.25) as a polycarboxylic acid of a material for the crystalline polyester polymerized segment and 274 parts by mass of 1,12-dodecanediol (molecular weight of 202.33) as a polyhydric alcohol were put and heated at 160° C. to be dissolved. A solution prepared in advance by mixing 23 parts by mass of styrene to be a material for the vinyl polymerized segment (amorphous polymerized segment), 6 parts by mass of n-butyl acrylate, 4 parts by mass of dicumyl peroxide as a peroxide-based polymerization initiator, and 2 parts by mass of acrylic acid as a dual reactive monomer was added thereto dropwise over 1 hour by using a dropping funnel. The mixture was continuously stirred for 1 hour while being maintained at 170° C. to polymerize styrene, n-butyl acrylate, and acrylic acid, 2.5 parts by mass of tin(II) 2-ethylhexanoate as an esterification catalyst and 0.2 parts by mass of gallic acid as an esterification promoter were added thereto, the temperature was raised to 210° C., and the reaction was conducted for 8 hours. The reaction was further conducted at 8.3 kPa for 1 hour, thereby obtaining a hybrid crystalline polyester resin (crystalline resin) [C1]. The content (hybrid ratio) of the vinyl polymerized segment (amorphous polymerized segment) in the crystalline resin [C1] thus obtained was 5% by mass.

The DSC curve of the crystalline resin [C1] thus obtained was acquired by using a differential scanning calorimeter "Diamond DSC" (manufactured by PerkinElmer Co., Ltd.) under a condition having a temperature raising rate of 10° C./min. The measurement result for the melting point (Tm) by a technique to measure the endothermic peak top temperature was 82.8° C., and Mw in terms of standard styrene was 28,000 as a measurement result for the molecular weight by using a GPC "HLC-8120 GPC" (manufactured by Tosoh Corporation). The results thus obtained are presented in the following Table 1.

[Preparation of Crystalline Resin Fine Particle Dispersion (C1)]

The crystalline resin [C1] was melted by 30 parts by mass and transported to an emulsifying and dispersing machine "CAVITRON CD1010" (manufactured by EUROTEC Co., Ltd.) in a molten state at a transporting speed of 100 parts by mass per minute. In addition, at the same time as the transport of this crystalline resin [C1] in a molten state, diluted ammonia water prepared by diluting 70 parts by mass of reagent ammonia water with ion exchanged water in an aqueous solvent tank so as to have a concentration of 0.37% by mass was transported to the emulsifying and dispersing machine at a transporting speed of 0.1 L/min while being heated at 100° C. by a heat exchanger. Thereafter, this emulsifying and dispersing machine was operated under conditions having a rotational speed of the rotor of 60 Hz and a pressure of 5 kg/cm$^2$, thereby preparing a crystalline resin fine particle dispersion 1 having a volume median diameter of 200 nm and a solid amount of 30 parts by mass. Incidentally, ammonia is added in order to ionically dissociate the carboxyl group contained in the crystalline resin and to stably emulsify it in the aqueous phase so that the emulsification smoothly proceeds. Incidentally, the crystalline resin fine particle dispersion 1 having a volume median diameter of 200 nm means that the volume median diameter of the crystalline resin fine particles (c1) in the crystalline resin fine particle dispersion (C1) is 200 nm (hereinafter, the same applies).

Synthesis Examples 2 to 6: Synthesis of Hybrid Crystalline Polyester Resins (Crystalline Resins) [C2] to [C4] and [C6] and Crystalline Polyester Resin [C5]

Hybrid crystalline polyester resins [C2] to [C4] and [C6] and a crystalline polyester resin [C5] were synthesized as a crystalline resin in the same manner as in Synthesis Example 1 except that the material ratio between the crystalline polyester polymerized segment and the vinyl polymerized segment was changed and the hybrid ratio was changed as presented in the following Table 1 in Synthesis Example 1. In the synthesis of the crystalline polyester resin [C5], the vinyl polymerized segment used in Synthesis Example 1 was not used.

The melting point and weight average molecular weight (Mw) of the hybrid crystalline polyester resins [C2] to [C4] and [C6] and the crystalline polyester resin [C5] were measured in the same manner as in Synthesis Example 1. The results thus obtained are presented in the following Table 1.

[Preparation of Crystalline Resin Fine Particle Dispersions (C2) to (C6)]

Crystalline resin fine particle dispersions (C2) to (C6) were prepared in the same manner as the preparation of crystalline resin fine particle dispersion (C1) except that the crystalline resins [C2] to [C6] were used instead of the crystalline resin [C1]. The volume median diameter of the crystalline resin fine particles (c2) to (c6) in the crystalline resin fine particle dispersions (C2) to (C6) thus obtained are as presented in Table 1.

TABLE 1

| | Crystalline resin | | Volume median diameter of | Vinyl polymerized segment (amorphous polymerized segment) | |
|---|---|---|---|---|---|
| | Weight average molecular weight Mw | Melting point (° C.) | crystalline resin fine particles (nm) | Structure | Content (hybrid ratio) (% by mass) |
| C1 | 28000 | 82.8 | 200 | Styrene acrylic | 5 |
| C2 | 27300 | 81.0 | 210 | Styrene acrylic | 15 |
| C3 | 28900 | 82.9 | 190 | Styrene acrylic | 0.1 |
| C4 | 29000 | 80.2 | 210 | Styrene acrylic | 30 |
| C5 | 30600 | 83.4 | 190 | — | — |
| C6 | 28600 | 79.6 | 220 | Styrene acrylic | 35 |

[Preparation of Coloring Agent Fine Particle Dispersion (Bk)]

In 1,600 parts by mass of ion exchanged water, 90 parts by mass of sodium dodecyl sulfate as a surfactant was stirred and dissolved. While stirring this solution, 420 parts by mass of carbon black "Regal 330R" (manufactured by Cabot Corporation) was gradually added thereto and subsequently dispersed by using a stirring apparatus "CLEARMIX" (manufactured by M Technique Co., Ltd.), thereby obtaining a coloring agent fine particle dispersion [Bk].

The particle diameter (volume median diameter) of the coloring agent fine particles in this coloring agent fine particle dispersion [Bk] was measured by using an electrophoretic light scattering photometer "ELS-800" (manufactured by Otsuka Electronics Co., Ltd.), and the result was 110 nm.

(Fabrication of Toner Base Particles (1))

(Aggregation and Fusion Step)

In a reaction vessel equipped with a stirring device, a temperature sensor, a cooling tube, and a nitrogen introducing device, 300 parts by mass (in terms of solid) of the amorphous resin fine particle dispersion (A1), 60 parts by mass (in terms of solid) of the crystalline resin fine particle dispersion (C1), 1100 parts by mass of ion exchanged water, and 40 parts by mass (in terms of solid) of the coloring agent fine particle dispersion [Bk] were put, and the liquid temperature was adjusted to 30° C., and the pH was then adjusted to 10 by adding a 5 N aqueous solution of sodium hydroxide. Subsequently, an aqueous solution prepared by dissolving 60 parts by mass of magnesium chloride as an aggregating agent in 60 parts by mass of ion exchanged water was added thereto at 30° C. over 10 minutes while stirring the mixture. After the mixture was maintained at this state for 3 minutes, the temperature raising was started, this system was heated to 85° C. over 60 minutes and aggregated while being maintained at 85° C., and the particle growth reaction was continuously conducted. In this state, the particle diameter of the aggregated particles was measured by using the "Coulter Multisizer 3" (manufactured by Beckman Coulter, Inc.), an aqueous solution prepared by dissolving 40 parts by mass of sodium chloride as a terminating agent in 160 parts by mass of ion exchanged water was added thereto to stop the particle growth at a time point at which the volume median diameter reached 6.0 μm, the resultant was heated and stirred in a state of being at 74° C. so that fusion of the particles proceeded, and the resultant was cooled to 30° C. at a cooling rate of 2.5° C./min at a time point at which the average circularity (number of detected HPFs: 4000) measured by using an apparatus for measuring the average circularity of the toner "FPIA-2100" (manufactured by Sysmex Corporation) reached 0.957.

(Cleaning and Drying Step)

The toner base particles thus produced were subjected to solid-liquid separation by a basket type centrifugal separator "MARK III, model number 60×40+M" (manufactured by MATSUMOTO MACHINE MFG. CO., LTD.) to form a wet cake of toner base particles. This wet cake was washed with ion exchanged water at 40° C. by using the basket type centrifugal separator until the electric conductivity of the filtrate reached 5 μS/cm, then transported to the "Flash Jet Dryer" (manufactured by SEISHIN ENTERPRISE CO., LTD.), and dried until the amount of moisture reached 0.5% by mass, thereby fabricating toner base particles [1].

(Fabrication of Toner Base Particles (2) to (11))

Toner base particles [2] to [11] were fabricated in the same manner as in the fabrication of toner base particles [1] except that the amount in terms of solid (amount of coloring agent) [parts by mass] in the coloring agent fine particle dispersion [Bk] was not changed and the ratio between the amount in terms of solid (amount of amorphous resin) [parts by mass] in the amorphous resin fine particle dispersion (A1) and the amount in terms of solid (amount of crystalline resin) [parts by mass] in the crystalline resin fine particle dispersion (one of (C1) to (C6)) was changed so as to be the content (% by mass) of the crystalline resin (one kind among (C1) to (C6)) presented in the following Table 4 in the fabrication of toner base particles [1].

The content [% by mass] of the crystalline resin in the toner base particles presented in the following Table 4 was calculated by the following formula (in terms of solid in all cases).

Content of crystalline resin in toner base particles [% by mass]=[amount of crystalline resin [parts by mass]/(amount of amorphous resin [parts by mass]+amount of crystalline resin [parts by mass]+amount of coloring agent [parts by mass])]×100 [Mathematical Formula 3]

[Lubricant (External Additive): Fabrication of Fatty Acid Metal Salt Particles [D1]]

To one prepared by adding 140 parts by mass of stearic acid to 1,000 parts by mass of ethanol and mixing them together at 75° C., 50 parts by mass of zinc hydroxide was gradually added, and they were mixed together for 1 hour. Thereafter, the resultant was cooled to 20° C., and the product was taken out and dried at 150° C. to remove ethanol therefrom. The solid matter of zinc stearate thus obtained was coarsely pulverized by using a hammer mill and subsequently finely pulverized by using a jet air pulverizer "I-20 Jet Mill" (manufactured by NIPPON PNEUMATIC MFG. CO., LTD.), and classified at a cut point of 4.5 μm by using a wind power type classifier "DS-20/DS-10 classifier" (manufactured by NIPPON PNEUMATIC MFG. CO., LTD.), thereby fabricating fatty acid metal salt particles [D1] that were composed of zinc stearate and had a volume median diameter of 3.9 μm.

[Fabrication of Fatty Acid Metal Salt Particles [D2]]

Fatty acid metal salt particles [D2] that were composed of zinc stearate and had a volume median diameter of 3.1 μm were fabricated in the same manner as the fabrication of fatty acid metal salt particles [D1] except that the cut point was changed from 4.5 μm to 3.6 μm.

[Fabrication of Fatty Acid Metal Salt Particles [D3]]

Fatty acid metal salt particles [D3] that were composed of zinc stearate and had a volume median diameter of 4.8 μm were fabricated in the same manner as the fabrication of fatty acid metal salt particles [D1] except that the cut point was changed from 4.5 μm to 5.4 μm.

[Fabrication of Fatty Acid Metal Salt Particles [D4]]

Fatty acid metal salt particles [D4] that were composed of zinc stearate and had a volume median diameter of 1.8 μm were fabricated in the same manner as the fabrication of fatty acid metal salt particles [D1] except that the cut point was changed from 4.5 μm to 2.2 μm.

[Fabrication of Fatty Acid Metal Salt Particles [D5]]

Fatty acid metal salt particles [D5] that were composed of zinc stearate and had a volume median diameter of 8.5 μm were fabricated in the same manner as the fabrication of fatty acid metal salt particles [D1] except that the cut point was changed from 4.5 μm to 8.9 μm.

The structure (composition) and volume median diameter of the fatty acid metal salt particles [D1] to [D5] of a lubricant (external additive) thus obtained are presented in the following Table 2.

TABLE 2

| Fatty acid metal salt particles | Structure (composition) | Volume median diameter (μm) |
|---|---|---|
| D1 | Zinc stearate | 3.9 |
| D2 | Zinc stearate | 3.1 |
| D3 | Zinc stearate | 4.8 |
| D4 | Zinc stearate | 1.8 |
| D5 | Zinc stearate | 8.5 |

[Fabrication of Large-Diameter External Additive E1]

(Fabrication of Spherical Silica Fine Particles 1)

(1) To a 3 liter reactor equipped with a stirrer, a dropping funnel, and a thermometer, 630 parts by mass of methanol and 90 parts by mass of water were added and mixed together. The hydrolysis of 800 parts by mass of tetramethoxysilane was conducted while stirring this solution, thereby obtaining a suspension of silica fine particles. Subsequently, the suspension was heated at 60 to 70° C. to distill off 390 parts by mass of methanol, thereby obtaining an aqueous suspension of silica fine particles.

(2) To this aqueous suspension, 11.6 parts by mass (amount equivalent to 0.1 as a molar ratio with respect to tetramethoxysilane) of methyltrimethoxysilane was added dropwise at room temperature to subject the surface of the silica fine particles to a hydrophobization treatment.

(3) To the dispersion thus obtained, 1400 parts by mass of methyl isobutyl ketone was added, and the mixture was then heated at 80° C. to distill off methanol. To the dispersion thus obtained, 240 parts by mass of hexamethyldisilazane was added at room temperature, and the mixture was heated at 120° C. and reacted for 3 hours to trimethylsilylate the silica fine particles. Thereafter, the solvent was distilled off under reduced pressure, thereby preparing spherical silica fine particles 1.

The number average primary particle diameter of the spherical silica fine particles 1 obtained by the above method was measured, and the result revealed that the spherical silica fine particles 1 (large-diameter external additive E1) having a number average primary particle diameter of 80 nm were obtained.

(Measurement of Number Average Primary Particle Diameter)

(Measurement of Volume Average Primary Particle Diameter of Silica Fine Particles)

The measurement of the volume average primary particle diameter of the silica fine particles was conducted as follows by using the "laser diffraction/scattering type particle size distribution measuring apparatus LA-750" (manufactured by Horiba, Ltd.).

Silica fine particles were added to methanol in a mass ratio of 1:0.005 and then dispersed therein by using an ultrasonic irradiator. The particle size distribution of the silica fine particles thus treated was measured by using the "laser diffraction/scattering type particle size distribution measuring apparatus LA-750" (manufactured by Horiba, Ltd.), and the average particle diameter thereof was determined. The average particle diameter thus determined is the so-called volume average particle diameter. Incidentally, the average particle diameter of the silica fine particles was measured by using an electron microscope and compared with the average particle diameter determined from the measurement result by the apparatus described above, it was confirmed that these values are consistent with each other, it was further confirmed that aggregation of the silica fine particles did not occur, and it was thus judged that the average particle diameter is that of the primary particles. By this, the average particle diameter was taken as the number average primary particle diameter of the silica particles.

Incidentally, the standard deviation of the volume average primary particle diameter can be simultaneously determined with the average particle diameter at the time of conducting the measurement by the "LA-750".

(Fabrication of Large-Diameter External Additive E2)

Spherical silica fine particles 2 (large-diameter external additive E2) having a number average primary particle diameter of 150 nm were fabricated in the same manner as the fabrication of spherical silica fine particles 1 except that tetramethoxysilane was changed to 1500 parts by mass and hexamethyldisilazane was changed to 360 parts by mass in the fabrication of spherical silica fine particles 1.

(Fabrication of Large-Diameter External Additive E3)

Spherical silica fine particles 3 (large-diameter external additive E3) having a number average primary particle diameter of 220 nm were fabricated in the same manner as the fabrication of spherical silica fine particles 1 except that tetramethoxysilane was changed to 2200 parts by mass and hexamethyldisilazane was changed to 510 parts by mass in the fabrication of spherical silica fine particles 1.

(Fabrication of Large-Diameter External Additive E4)

Spherical silica fine particles 4 (large-diameter external additive E4) having a number average primary particle diameter of 30 nm were fabricated in the same manner as the fabrication of spherical silica fine particles 1 except that tetramethoxysilane was changed to 325 parts by mass and hexamethyldisilazane was changed to 110 parts by mass in the fabrication of spherical silica fine particles 1.

(Fabrication of Large-Diameter External Additive E5)

In a glass reactor equipped with a thermometer, a reflux condenser, a nitrogen gas introduction tube, and a stirrer, 200 parts of deionized water and 3 parts of sodium lauryl sulfate were put, the temperature thereof was raised to from 80 to 85° C. while ventilating with nitrogen gas, 1 part of ammonium persulfate was added thereto while stirring the mixture, a monomer mixture composed of 40 parts by mass of methyl methacrylate and 40 parts by mass of styrene of a non-crosslinkable monomer and 20 parts by mass of divinylbenzene of a crosslinkable vinyl monomer was added thereto dropwise over 1 hour, and subsequently the mixture was continuously stirred for 1 hour. The emulsion thus obtained was dried through spray drying, thereby obtaining spherical organic fine particles 5 (large-diameter external additive E5) of crosslinked vinyl-based resin particles having a number average primary particle diameter of 100 nm.

The kinds and number average primary particle diameters of the large-diameter external additives E1 to E5 thus obtained are presented in the following Table 3.

TABLE 3

| Large-diameter external additive | External additive | Number average primary particle diameter (nm) |
|---|---|---|
| E1 | Silica fine particles | 80 |
| E2 | Silica fine particles | 150 |
| E3 | Silica fine particles | 220 |
| E4 | Silica fine particles | 30 |
| E5 | Organic fine particles (crosslinked vinyl-based resin particles) | 100 |

(Treatment of Toner 1 with External Additive: Adhesion (External Addition) Treatment of External Additive to Toner Base Particles [1])

The following powders (various kinds of external additives such as a lubricant and a large-diameter external additive) are added to the toner base particles [1] in the following amounts (proportions (parts by mass) of external additives to 100 parts by mass of toner base particles [1]), the mixture was added to the Henschel mixer model "FM 20C/I" (manufactured by NIPPON COKE AND ENGINEERING CO., LTD.), the number of rotations of the stirring blade was set such that the circumferential velocity of the blade tip was 40 m/s, and the mixture was stirred and mixed for 25 minutes, thereby fabricating a toner 1. The adhesive strength of the fatty acid metal salt particles (lubricant) [D1] in the toner 1 thus obtained was measured. The results thus obtained are presented in Table 4.

Spherical silica fine particles 1 (large-diameter external additive E1) 1.0 part by mass Hydrophobic silica (R805 manufactured by Evonik) 0.8 part by mass Hydrophobic titanium oxide (JMT-150IB manufactured by Tayca Corporation) 0.5 part by mass Fatty acid metal salt particles (lubricant) [D1] 0.2 part by mass The temperature of the mixed powder at the time of externally adding and mixing the powders described above to the toner base particles [1] was set to 40±1° C. The internal temperature of the Henschel mixer was controlled by allowing the cooling water to flow into the outer bath of the Henschel mixer at a flow rate of 5 L/min when the temperature reached 41° C. and allowing the cooling water to flow at a flow rate of 1 L/min when the temperature reached 39° C.

(Method of Fabricating Toners 2 to 20)

Toner base particles having different amounts of crystalline resin were used and the kind and parts of the fatty acid metal salt added, the kind of large-diameter external additive, and the stirring and mixing time for the external addition treatment were changed as presented in the following Table 4 so that the adhesive strength of the fatty acid metal salt particles was adjusted in the fabrication of toner 1, thereby fabricating toners 2 to 20. It is described in detail below.

Example 2: Fabrication of Toner 2

Toner 2 was fabricated in the same manner as in the fabrication of toner 1 described above except that the toner base particles [2] presented in the following Table 4 were used in the external addition treatment of toner 1.

Example 3: Fabrication of Toner 3

Toner 3 was fabricated in the same manner as in the fabrication of toner 1 described above except that the toner base particles [3] presented in the following Table 4 were used in the external addition treatment of toner 1.

Example 4: Fabrication of Toner 4

Toner 4 was fabricated in the same manner as in the fabrication of toner 1 described above except that the toner base particles [4] presented in the following Table 4 were used in the external addition treatment of toner 1.

Example 5: Fabrication of Toner 5

Toner 5 was fabricated in the same manner as in the fabrication of toner 1 described above except that the toner base particles [5] presented in the following Table 4 were used, E2 was used as the spherical silica fine particles (large-diameter external additive), and the stirring and mixing time was set to 20 minutes in the external addition treatment of toner 1.

Example 6: Fabrication of Toner 6

Toner 6 was fabricated in the same manner as in the fabrication of toner 1 described above except that the toner base particles [6] presented in the following Table 4 were used in the external addition treatment of toner 1.

Example 7: Fabrication of Toner 7

Toner 7 was fabricated in the same manner as in the fabrication of toner 1 described above except that the toner base particles [7] presented in the following Table 4 were used in the external addition treatment of toner 1.

Example 8: Fabrication of Toner 8

Toner 8 was fabricated in the same manner as in the fabrication of toner 1 described above except that the toner base particles [8] presented in the following Table 4 were used, [D3] was used as the fatty acid metal salt particles (lubricant), and the stirring and mixing time was set to 28 minutes in the external addition treatment of toner 1.

Example 9: Fabrication of Toner 9

Toner 9 was fabricated in the same manner as in the fabrication of toner 1 described above except that the toner base particles [8] presented in the following Table 4 were used and [D2] was used as the fatty acid metal salt particles (lubricant) in the external addition treatment of toner 1.

Example 10: Fabrication of Toner 10

Toner 10 was fabricated in the same manner as in the fabrication of toner 1 described above except that the toner base particles [9] presented in the following Table 4 were used and the stirring and mixing time was set to 28 minutes in the external addition treatment of toner 1.

Example 11: Fabrication of Toner 11

Toner 11 was fabricated in the same manner as in the fabrication of toner 1 described above except that the toner base particles [9] presented in the following Table 4 were used and the stirring and mixing time was set to 15 minutes in the external addition treatment of toner 1.

Example 12: Fabrication of Toner 12

Toner 12 was fabricated in the same manner as in the fabrication of toner 1 described above except that the toner base particles [9] presented in the following Table 4 were used and E5 was used as the spherical silica fine particles (large-diameter external additive) in the external addition treatment of toner 1.

Example 13: Fabrication of Toner 13

Toner 13 was fabricated in the same manner as in the fabrication of toner 1 described above except that the rotational speed of the stirring blade was set to 30 m/s and the stirring and mixing time was set to 15 minutes in the external addition treatment of toner 1.

Example 14: Fabrication of Toner 14

Toner 14 was fabricated in the same manner as in the fabrication of toner 1 described above except that the rotational speed of the stirring blade was set to 50 m/s in the external addition treatment of toner 1.

Example 15: Fabrication of Toner 15

Toner 15 was fabricated in the same manner as in the fabrication of toner 1 described above except that E4 was used as the spherical silica fine particles (large-diameter external additive) in the external addition treatment of toner 1.

Example 16: Fabrication of Toner 16

Toner 16 was fabricated in the same manner as in the fabrication of toner 1 described above except that E3 was used as the spherical silica fine particles (large-diameter external additive) and the stirring and mixing time was set to 20 minutes in the external addition treatment of toner 1.

Example 17: Fabrication of Toner 17

Toner 17 was fabricated in the same manner as in the fabrication of toner 1 described above except that the toner base particles [10] presented in the following Table 4 were used in the external addition treatment of toner 1.

Comparative Example 1

Fabrication of Toner 18

Toner 18 was fabricated in the same manner as in the fabrication of toner 1 described above except that [D4] was used as the fatty acid metal salt particles (lubricant) and the stirring and mixing time was set to 15 minutes in the external addition treatment of toner 1.

Comparative Example 2: Fabrication of Toner 19

Toner 19 was fabricated in the same manner as in the fabrication of toner 1 described above except that [D5] was used as the fatty acid metal salt particles (lubricant) in the external addition treatment of toner 1.

Comparative Example 3: Fabrication of Toner 20

Toner 20 was fabricated in the same manner as in the fabrication of toner 1 described above except that the toner base particles [11] presented in the following Table 4 were used in the external addition treatment of toner 1.

The adhesive strength of fatty acid metal salt particles (lubricant) attached (externally added) to the toners 2 to 20 obtained in Examples 2 to 17 and Comparative Examples 1 to 3 was measured. The results thus obtained are presented in the following Table 4.

(Fabrication of Resin for Coating Core Material (Coating Material 1))

Cyclohexyl methacrylate and methyl methacrylate were added to a 0.3% by mass aqueous solution of sodium benzenesulfonate in a molar ratio of 1:1, potassium persulfate was added thereto in an amount corresponding to 0.5% by mass of the total amount of the monomers, the emulsion polymerization was conducted, the resin particles in the dispersion thus obtained were dried through spray drying of the dispersion, thereby fabricating a coating material 1 of a resin for coating the core material.

(Fabrication of Carrier Particles 1)

Mn—Mg-based ferrite particles having a volume average diameter (volume median diameter) of 30 μm were prepared as core material particles. In a high-speed stirring and mixing machine equipped with horizontal stirring blades, 100 parts by mass of the ferrite particles (core material particles) and 4.5 parts by mass of the coating material 1 were put and stirred and mixed at 22° C. for 15 minutes under a condition having a circumferential velocity of the horizontal rotary blade of 8 m/sec. Thereafter, the mixture was mixed at 120° C. for 50 minutes to coat the coating material 1 on the surface of the core material particles by the action of a mechanical impact force (mechanochemical method), thereby fabricating carrier particles 1. The volume (distribution) median diameter of the carrier particles 1 was 30 μm.

(Fabrication of Two-Component Developers 1 to 20)

The toners 1 to 20 and carrier particles 1 were mixed in a V-type mixer for 30 minutes such that the content (toner concentration) of the toner (particles) in the two-component developer was 7% by mass, thereby fabricating two-component developers 1 to 20 to be used for evaluation.

[Evaluation Method]

(Low Temperature Fixability: Fold Fixability)

<Low Temperature Fixability>

The two-component developer was mounted on a copying machine "bizhub PRO (registered trademark) C6501" (manufactured by Konica Minolta, Inc.) in which the fixing device was modified so that the surface temperature of the heat roller for fixing was able to be changed in a range of 100 to 210° C. A fixing experiment in which a solid image having an amount of toner attached of 11 g/m$^2$ was fixed on A4 size plain paper (basis weight of 80 g/m$^2$) was repeatedly conducted wile changing the set fixing temperature from 100° C. to 180° C. so as to increase in units of 5° C.

Subsequently, the printed matter obtained in the fixing experiment at each fixing temperature was folded by a folding machine so as to apply a load to the solid image, compressed air at 0.35 MPa was blown onto this, and the fold was ranked in 5 stages according to the following rank criteria. The fixing temperature in the fixing experiment having the lowest fixing temperature among the fixing experiments judged rank 3 or higher was taken as the lowest fixing temperature, and a fixing temperature of 140° C. or lower was judged to be acceptable.

(Rank Criteria of Fold)

Rank 5: Peeling off along fold is not observed at all

Rank 4: Peeling off along part of fold is observed

Rank 3: Fine linear peeling off along fold is observed

Rank 2: Thick linear peeling off along fold is observed

Rank 1: Great peeling off is observed (Acceptance Criteria)

It is required to achieve rank 3 or higher at a fixing temperature of 140° C. or lower.

(Cleaning Property: Image Defect due to Slipping Through of External Additive)

A test image having 5 vertical band-shaped solid images with a width of 3 cm was continuously printed (durable printing) on 100,000 sheets of high quality A4 paper (65 g/m$^2$), the overall solid image after being aged was output, the density at five portions corresponding to the band portion at the time of being aged and the density at 6 portions corresponding to the non-band portion were measured by using the Macbeth transmission reflection densitometer "RD907" (manufactured by Macbeth), the cleaning property was evaluated by the maximum density difference and judged according to the following criteria. The maximum density difference of 0.10 or less was judged to be practically usable.

(Evaluation Criteria of Cleaning Property (CL Property))

⊙: Maximum density difference is 0.03 or less

○: Maximum density difference is greater than 0.03 and 0.06 or less

Δ: Maximum density difference is greater than 0.06 and 0.10 or less x: Maximum density difference is greater than 0.10.

TABLE 4

| | Toner No. | Toner base particles No. | Crystalline resin Kind | Content of amorphous polymerized segment (% by mass) | Content (% by mass) | Fatty acid metal salt particles Kind | Added amount (% by mass) | Adhesive strength (%) | Large-diameter external additive Kind | Number average primary particle diameter (nm) | Added parts (parts by mass) | Lowest fixing temperature to be judged rank 3 (° C.) | CL property (slipping through of external additive) |
|---|---|---|---|---|---|---|---|---|---|---|---|---|---|
| Example 1 | Toner 1 | 1 | C1 | 5 | 15 | D1 | 0.2 | 61 | E1 | 80 | 1.0 | 120 | ⊙ |
| Example 2 | Toner 2 | 2 | C1 | 5 | 15 | D1 | 0.2 | 56 | E1 | 80 | 1.0 | 120 | ⊙ |
| Example 3 | Toner 3 | 3 | C1 | 5 | 30 | D1 | 0.2 | 55 | E1 | 80 | 1.0 | 120 | ○ |
| Example 4 | Toner 4 | 4 | C1 | 5 | 5 | D1 | 0.2 | 52 | E1 | 80 | 1.0 | 120 | ○ |
| Example 5 | Toner 5 | 5 | C2 | 15 | 20 | D1 | 0.2 | 46 | E2 | 150 | 1.0 | 120 | ○ |
| Example 6 | Toner 6 | 6 | C3 | 0.1 | 5 | D1 | 0.2 | 59 | E1 | 80 | 1.0 | 135 | ⊙ |
| Example 7 | Toner 7 | 7 | C4 | 30 | 30 | D1 | 0.2 | 55 | E1 | 80 | 1.0 | 120 | ⊙ |
| Example 8 | Toner 8 | 8 | C2 | 15 | 30 | D3 | 0.2 | 62 | E1 | 80 | 1.0 | 120 | ○ |
| Example 9 | Toner 9 | 8 | C2 | 15 | 30 | D2 | 0.2 | 67 | E1 | 80 | 1.0 | 125 | ○ |
| Example 10 | Toner 10 | 9 | C1 | 5 | 20 | D1 | 0.2 | 68 | E1 | 80 | 1.0 | 125 | ○ |
| Example 11 | Toner 11 | 9 | C1 | 5 | 20 | D1 | 0.2 | 41 | E1 | 80 | 1.0 | 125 | ○ |
| Example 12 | Toner 12 | 9 | C1 | 5 | 20 | D1 | 0.2 | 54 | E5 | 100 | 1.0 | 120 | ○ |
| Example 13 | Toner 13 | 1 | C1 | 5 | 15 | D1 | 0.2 | 25 | E1 | 80 | 1.0 | 125 | Δ |
| Example 14 | Toner 14 | 1 | C1 | 5 | 15 | D1 | 0.2 | 85 | E1 | 80 | 1.0 | 125 | Δ |
| Example 15 | Toner 15 | 1 | C1 | 5 | 15 | D1 | 0.2 | 64 | E4 | 30 | 1.0 | 125 | ○ |
| Example 16 | Toner 16 | 1 | C1 | 5 | 15 | D1 | 0.2 | 48 | E3 | 220 | 1.0 | 120 | Δ |
| Example 17 | Toner 17 | 10 | C6 | 35 | 15 | D1 | 0.2 | 55 | E1 | 80 | 1.0 | 130 | ○ |
| Comparative Example 1 | Toner 18 | 1 | C1 | 5 | 15 | D4 | 0.2 | 45 | E1 | 80 | 1.0 | 125 | X |
| Comparative Example 2 | Toner 19 | 1 | C1 | 5 | 15 | D5 | 0.2 | 57 | E1 | 80 | 1.0 | 120 | X |
| Comparative Example 3 | Toner 20 | 11 | C5 | — | 15 | D1 | 0.2 | 63 | E1 | 80 | 1.0 | 150 | ⊙ |

The content of the crystalline resin in Table 4 above represents the proportion (% by mass) of the crystalline resin in the toner base particles.

From the results in Table 4 above, it has been found that the low temperature fixability (fold fixability) and the cleaning property (suppression of slipping through of external additives and eventually suppression of image defects due to slipping through of external additives) which were difficult to be achieved at the same time in the prior art can be both achieved in the toners [1] to [17] of Examples 1 to 17 having the configuration according to an embodiment of the present invention.

On the other hand, it has been found that it is difficult to achieve both the low temperature fixability (fold fixability) and the cleaning property (suppression of slipping through of external additives and eventually suppression of image defects due to slipping through of external additives) in the toners [18] to [20] of Comparative Examples 1 to 3 in the same manner as in the prior art.

Although the present invention has been described and illustrated in detail, it is clearly understood that the same is by way of illustrated and example only and is not to be taken byway of limitation, the scope of the present invention being interpreted by terms of the appended claims.

What is claimed is:

1. A toner for developing an electrostatic latent image comprising:

toner base particles containing a hybrid crystalline polyester resin having a crystalline polyester polymerized segment and an amorphous polymerized segment chemically bonded to each other and an amorphous resin; and an external additive including fatty acid metal salt particles, wherein a volume median diameter of the fatty acid metal salt particles is from 3.0 to 5.0 μm, and the amorphous polymerized segment is a vinyl polymerized segment, and the amorphous resin is a vinyl resin.

2. The toner for developing an electrostatic latent image according to claim 1, wherein a content of the amorphous polymerized segment in the hybrid crystalline polyester resin is from 0.1 to 30% by mass.

3. The toner for developing an electrostatic latent image according to claim 1, wherein the hybrid crystalline polyester resin is contained in the toner base particles at 5 to 30% by mass.

4. The toner for developing an electrostatic latent image according to claim 1, wherein a content of the amorphous resin is in a range of 20 to 99% by mass with respect to the entire amount of the toner base particles.

5. The toner for developing an electrostatic latent image according to claim 1, wherein an adhesive strength of the fatty acid metal salt particles is from 40 to 70%.

6. The toner for developing an electrostatic latent image according to claim 1, wherein the external additive includes an external additive other than the fatty acid metal salt particles, and the external additive having the largest number average primary particle diameter among the external additives other than the fatty acid metal salt particles is inorganic fine particles having a number average primary particle diameter of from 60 to 200 nm.

7. A toner for developing an electrostatic latent image, wherein the inorganic fine particles described in claim 6 are silica particles.

8. A two-component developer for developing an electrostatic latent image comprising:

the toner for developing an electrostatic latent image according to claim 7; and carrier particles.

9. A two-component developer for developing an electrostatic latent image comprising:

the toner for developing an electrostatic latent image according to claim 1; and carrier particles.

10. The two-component developer for developing an electrostatic latent image according to claim 9, wherein the carrier particles are coated type carrier particles having core material particles and a layer of a coating material (carrier coating resin) to coat a surface of the core material particles.

* * * * *